US006318848B1

(12) United States Patent
Iwasaki et al.

(10) Patent No.: US 6,318,848 B1
(45) **Date of Patent: *Nov. 20, 2001**

(54) LIQUID JET HEAD WITH A MOVABLE MEMBER, HEAD CARTRIDGE USING THE LIQUID JET HEAD, LIQUID JET APPARATUS AND LIQUID DISCHARGING METHOD

(75) Inventors: Osamu Iwasaki, Tokyo; Toshio Kashino, Chigasaki; Hiroshi Tajika, Yokohama; Yasutoshi Saito, Kawasaki; Masaya Uetuki, Yokohama; Hidehiko Kanda, Kawaskai; Yoshie Asakawa, Hotaka-machi, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/888,048

(22) Filed: Jul. 3, 1997

(30) Foreign Application Priority Data

Jul. 9, 1996 (JP) ..... 8-179696

(51) Int. Cl.[7] ..... B41J 2/05
(52) U.S. Cl. ..... 347/65
(58) Field of Search ..... 347/65, 63, 54, 347/56

(56) References Cited

U.S. PATENT DOCUMENTS

| | | | |
|---|---|---|---|
| 4,723,129 | 2/1988 | Endo et al. . | |
| 4,994,825 | 2/1991 | Saito et al. . | |
| 5,166,699 | 11/1992 | Yano et al. . | |
| 5,208,604 | 5/1993 | Watanabe et al. . | |
| 5,278,585 | 1/1994 | Karz et al. | 347/65 |
| 5,367,325 | 11/1994 | Yano et al. . | |
| 5,389,957 | 2/1995 | Kimura et al. . | |
| 5,565,899 | 10/1996 | Sugimoto et al. . | |
| 5,625,384 | 4/1997 | Numata et al. . | |
| 5,731,828 * | 3/1998 | Ishinaga | 347/62 |
| 5,821,962 * | 10/1998 | Kudo | 347/65 |

FOREIGN PATENT DOCUMENTS

| | | | |
|---|---|---|---|
| 0 419 191 | 3/1991 | (EP) . | |
| 0 436 047 | 7/1991 | (EP) | B41J/2/055 |
| 5-124189 | 5/1993 | (JP) | B41J/2/05 |
| 63-199972 | 8/1988 | (JP) | F16K/15/14 |

* cited by examiner

*Primary Examiner*—Sandra Brase
(74) *Attorney, Agent, or Firm*—Fitzpatrick, Cella, Harper & Scinto

(57) ABSTRACT

A liquid jet head is provided with discharge ports for discharging liquid, liquid flow paths conductively connected with the discharge ports, air bubble generating areas for creating air bubbles in the liquid, and movable members arranged to face the air bubble generating areas, each having a free end in a position relatively near to the discharge port with respect to a fulcrum thereof. This movable member is inclined to position the free end of the movable member to release the air bubble generating area partly to the discharge port so as to enable the tangential line of the free end of the movable member on the side of the air bubble generating area or the extended line thereof to reach directly the discharge port formation area having the discharge port on the liquid flow path side before the creation of air bubble on the air bubble generating area, and with this position as reference, the movable member is displaced following the creation of air bubble on the air bubble generating area. With this arrangement, the liquid discharging efficiency and speed are significantly enhanced as compared with the conventional liquid jet head, and due to more stabilized discharge of droplets from the discharge ports, the quality of recorded images is improved.

53 Claims, 17 Drawing Sheets

LIQUID JET HEAD WITH A MOVABLE MEMBER, HEAD CARTRIDGE USING THE LIQUID JET HEAD, LIQUID JET APPARATUS AND LIQUID DISCHARGING METHOD

BACKGROUND OF THE INVENTION

1. Field of the Invention

The present invention relates to a liquid jet head for discharging a desired liquid by the creation of air bubbles brought about by causing thermal energy to act upon liquid, a head cartridge using the liquid jet head, a liquid jet apparatus, and a liquid discharging method. The invention also relates to an ink jet kit provided with the liquid jet head.

More particularly, the invention relates to a liquid jet head having movable members capable of being displaced by the utilization of the creation of air bubbles. It also relates to a head cartridge using the liquid jet head, and a liquid jet apparatus.

The present invention is also applicable to a printer for recording on a recording medium, such as paper, thread, fabric, cloth, leather, plastic, glass, wood, or ceramics, and also, to a copying machine, a facsimile equipment provided with communication systems, a word processor or other apparatuses having a printing unit therefor. Further, the present invention is applicable to a recording system for industrial use, which is complexly combined with various processing apparatuses.

Here, the term "recording" in the description of the present invention means not only the provision of images having characters, graphics, or other meaningful representation, but only the provision of those images that do not present any meaning, such as patterns.

2. Related Background Art

There has been known the so-called bubble jet recording method, which is an ink jet recording method whereby to form images on a recording medium by discharging ink from discharge ports using acting force exerted by the change of states of ink brought about by the abrupt voluminal changes (creation of air bubbles) when thermal energy or the like is applied to ink in accordance with recording signals. For the recording apparatus that uses the bubble jet recording method, it is generally practiced to provide, as disclosed in the specifications of U.S. Pat. No. 4,723,129 and others, the discharge ports that discharge ink, the ink paths conductively connected to the discharge ports, and electrothermal transducing elements arranged in each of the ink paths as means for generating energy for discharging ink. Then, it is generally practiced for the bubble jet recording method that the air bubbles are developed by means of film boiling generated in liquid.

In accordance with such recording method, it is possible to record high quality images at high speeds with a lesser amount of noises. At the same time, the head that executes this recording method makes it possible to arrange the discharge ports for discharging ink in high density, with the advantage, among many others, that images are recordable in high resolution, and that color images are easily obtainable by use of a smaller apparatus. In recent years, therefore, the bubble jet recording method is widely adopted for many kinds of office equipment, such as a printer, a copying machine, a facsimile equipment. Further, this recording method is utilized even for industrial systems, such as a textile printing, among others.

Along the wider utilization of bubble jet technologies and techniques for various products in many different fields, there have been increasingly more demands technically in recent years as given below.

For example, as to the demand on the improvement of energy efficiency, the adjustment of the thickness of protection film has been studied to optimize the performance of heat generating elements. A study of the kind has produced effects on the enhancement of transfer efficiency of generated heat to liquids. Also, in order to obtain high quality images, there has been proposed a driving condition under which a liquid discharging method or the like is arranged to be able to execute good ink discharges at higher ink discharging speeds with more stabilized creation of air bubbles. Also, from the viewpoint of a high-speed recording, there has been proposed the improved configuration of liquid flow paths that makes it possible to obtain a liquid jet head capable of refilling liquid to the liquid flow paths at higher speeds after discharging.

Of the various configurations of liquid flow paths thus proposed, those represented in FIGS. 22A and 22B are disclosed in the specification of Japanese Patent Laid-Open Application No. 63-199972 as a liquid flow path structure. The liquid flow path structure and a method for manufacturing heads disclosed in the specification thereof are the inventions devised with attention to the back waves (the pressure orientated opposite to the direction toward the discharge ports, that is, pressure exerted in the direction toward the liquid chamber 12). The back waves are known as energy loss because such energy is not exerted in the discharging direction.

FIGS. 22A and 22B illustrate valves 10, each arranged away from the air bubble generating area of the heat generating element 2, and positioned in the side opposite to the discharge port 11 with respect to the heat generating element 2. It is disclosed that the valve 10 keeps its initial position as being adhesively bonded to the ceiling of the liquid flow path 3 by means of a method of manufacture utilizing a plate material or the like, and falls down inside the liquid flow path 3 along the creation of the air bubble as represented in FIG. 22B. It is further disclosed that the invention relates to a method for suppressing the energy loss by controlling the back waves described above partly by the arrangement of the valves 10.

However, in accordance with the disclosed structure, even if the back waves are partly controlled by means of valves 10 for the suppression thereof, it is not necessarily sufficient to enhance the capability of liquid discharge. This is clearly understandable from studies on the condition under which the air bubbles are created in the liquid flow path 3 that retains in it liquid to be discharged.

Fundamentally, the back waves themselves are not related directly with discharging as described earlier. Of the components of pressure exerted by each air bubble, those directly related with discharge have already acted upon liquid to be in the state of being discharged from the liquid flow path 3 the moment the back waves are generated in the flow path 3 as indicated in FIG. 22B. Therefore, even if the back waves are suppressed, it is difficult to provide a sufficient contribution to enhancing the discharging performance, notwithstanding its partial suppression as described above.

The applicant hereof has already filed an application for a patent based on a completely new invention for positively controlling air bubbles in order to enhance the fundamental discharging properties to such a high level that has never been anticipated in the conventional art by giving light upon the aspects that have not been considered with respect to the conventional method for discharging liquid by the creation of air bubbles (particularly, those following film boiling) in each of the liquid flow paths. In accordance with this invention, the positive control of air bubbles is made possible by arranging the positional relationship between the fulcrum and free end of each movable member in such a manner that the free end thereof is positioned on the discharge port side, that is, on the downstream side, and also, by arranging each of the movable members in a position to face the air bubble generating area.

With the knowledge that the developing component of the air bubble on the downstream side should be altered and effectively directed to the discharging side in consideration of the developing component of the air bubble on the downstream side, and that this directional change of such component should only bring about the enhancement of the discharging efficiency and discharging speeds, the present invention is designed to shift the developing component of the air bubble on the downstream side to the free end side of the movable member positively. Therefore, it is required to apply an art of extremely high standard to the implementation thereof as compared with the level of the conventional technologies and techniques in this field.

With such technical background as described above, the inventor et al hereof have found further that it is possible to reduce the load more at the time of initiating the displacement of the movable member by adjusting the condition of the free end of the movable member before the creation of the air bubble in consideration of the function of the movable member when its displacement is initiated.

With the knowledge thus obtained, the inventor et al hereof have found the excellent principle of liquid discharge. Thus, in accordance with such discharging principle, the present invention has been made.

The prime objective of the invention is given below.

It is a first object of the invention to provide the principle of liquid discharge, which is quite new with respect to the fundamental control of created air bubbles.

It is a second object of the invention to provide a liquid discharging method capable of discharging liquid in good condition, a liquid jet head, and others.

It is a third object of the invention to provide a liquid jet head and others operative at increased printing speed or the like by suppressing the inertial force exerted by back waves, which acts in the direction opposite to the direction of liquid supply, and at the same time, by reducing the regressive amount of meniscus using the valve function of each movable member for the enhancement of refilling frequency.

It is a fourth object of the invention to provide a liquid jet head or the like having a sufficiently high discharging efficiency and discharging power to facilitate the valve opening and closing operations at the time of initiating the discharge operation for a pattern recording that necessitates the repetition of recording required for its initial operation, and frequent discharge and suspension as well.

It is a fifth object of the invention to provide a head kit to facilitate the reuse of the liquid jet head of the present invention.

SUMMARY OF THE INVENTION

For the achievement of the objects described above, a typical prerequisite for the present invention is as follows:

A liquid jet head provided with discharge ports for discharging liquid; liquid flow paths conductively connected with the discharge ports; air bubble generating areas for causing liquid to create air bubbles; and movable members, each arranged to face the air bubble generating area, having the free end in a position relatively near to the discharge port with respect to the fulcrum thereof, the movable member being inclined to position the free end of the movable member to release the air bubble generating area partly to the discharge port so as to enable the tangential line of the free end of the movable member on the side of the air bubble generating area or the extended line thereof to reach directly the discharge port formation area having the discharge port on the liquid flow path side before the creation of air bubble on the air bubble generating area, and with this position as reference, the movable member being displaced following the creation of air bubble on the air bubble generating area.

A liquid jet head provided with discharge ports for discharging liquid, liquid flow paths conductively connected with the discharge ports, air bubble generating areas for creating air bubbles in the liquid, and movable members arranged to face the air bubble generating areas, each having a free end in a position relatively near to the discharge port with respect to a fulcrum thereof, the free end of the movable member being arranged in a position further away from the air bubble generating area than the fulcrum before the creation of air bubble when the movable member is not displaced following the pressure exerted by the creation of air bubble on the air bubble generating area.

A liquid jet head provided with first liquid flow paths conductively connected with the discharge ports for discharging liquid, second liquid flow paths having the air bubble generating areas to give heat to liquid so as to create air bubble in the liquid, and movable members arranged to face the air bubble generating areas, each having a free end in a position relatively near to the discharge port with respect to a fulcrum thereof, the free end of the movable member being displaced to the first liquid flow path side in order to enable the second liquid flow path and the first liquid flow path to be conductively connected before the creation of air bubble when the movable member is not displaced following the pressure exerted by the creation of air bubble on the air bubble generating area.

A liquid discharging method, comprising the following steps of:

preparing a liquid jet head provided with discharge ports for discharging liquid, liquid flow paths conductively connected with the discharge ports, air bubble generating areas for creating air bubbles in the liquid, and movable members arranged to face the air bubble generating areas, each having a free end in a position relatively near to said discharge port with respect to a fulcrum thereof;

causing the movable member to be inclined to position the free end of the movable member to release the air bubble generating area partly to the discharge port so as to enable the tangential line of the free end of the movable member on the side of the air bubble generating area or the extended line thereof to reach directly the discharge port formation area having the discharge port on the liquid flow path side before the creation of air bubble on the air bubble generating area; and with this position as reference, displacing the movable member following the creation of air bubble on the air bubble generating area.

A liquid discharging method for discharging liquid by the creation of air bubbles, comprising the following steps of:

preparing a liquid jet head provided with discharge ports for discharging liquid, liquid flow paths conductively connected with the discharge ports, air bubble generating areas for creating air bubbles in the liquid, and movable members arranged to face the air bubble generating areas, each having a free end in a position relatively near to the discharge port with respect to a fulcrum thereof, at the same time, the free end of the movable member being arranged in a position further away from the air bubble generating area than the fulcrum before the creation of air bubble when the movable member is not displaced following the pressure exerted by the creation of air bubble on the air bubble generating area; and displacing the free end of the movable member by pressure exerted by the creation of air bubble on the air bubble generating area to discharge liquid from the discharge port.

A liquid discharging method discharging liquid by the creation of air bubbles, comprising the following steps of:

preparing a liquid jet head provided with first liquid flow paths conductively connected with the discharge ports for discharging liquid, second liquid flow paths having the air bubble generating areas to give heat to liquid so as to create air bubble in the liquid, and movable members arranged to face the air bubble generating areas, each having a free end in a position relatively near to said discharge port with respect to a fulcrum thereof, at the same time, the free end of the movable member being displaced to the first liquid flow path side in order to enable the second liquid flow path and the first liquid flow path to be conductively connected before the creation of air bubble when the movable member is not displaced following the pressure exerted by the creation of air bubble on the air bubble generating area; and displacing the free end of the movable member by pressure exerted by the creation of air bubbles on the air bubble generating area to discharge liquid from the discharge port.

A head cartridge provided with a liquid jet head described above; and a liquid container retaining liquid to be supplied to this liquid jet head.

A head cartridge provided with a liquid jet head and a liquid container retaining a first liquid to be supplied to the first liquid flow path, and a second liquid to be supplied to the second liquid flow path.

A liquid jet apparatus using a liquid jet head described above, and being provided with means for supplying driving signals for discharging liquid from the liquid jet head.

A liquid jet apparatus using a liquid jet head described above, and being provided with means for carrying a recording medium to enable the recording medium to receive liquid discharged from the liquid jet head.

A head kit housing therein a liquid jet head described above, and a liquid container retaining liquid to be supplied to the liquid jet head.

A head kit provided with a liquid jet head described above; a liquid container retaining liquid to be supplied to the liquid jet head; and means for filling liquid to the liquid container.

As described above, in accordance with the liquid discharging method, liquid jet head, and others of the present invention based upon the extremely new discharging principle, it is possible to obtain the mutually potentiating effect of the creation of bubbles, and the movable members to be displaced thereby, which brings about the effective discharge of liquid in the vicinity of the discharge ports. As compared with the conventional bubble jet type discharging method, and head, discharging efficiency is enhanced. For example, in the most preferable mode in accordance with the present invention, it is attained to enable the discharging efficiency to present a quantum leap of as much as more than two times the conventional method and head.

With the structure of the present invention, it is possible to prevent discharging from being disabled even when the head is left intact for a long time at low temperatures and low humidity. If discharging should become disabled, it is possible to restore the head to be in the normal condition immediately by slightly executing a recovery process, such as a pre-discharge, suction recovery.

More specifically, even when a majority of 64 discharge ports of the conventional bubble jet type head are disabled because it has been left intact for such a long time, only approximately a half or less of the discharge ports of the head of the present invention present the state of defective discharging. Also, in order to recover these defective discharge ports, it is required to execute several thousands of pre-discharge shoots for each of the discharge ports in case of the conventional head. However, in accordance with the present invention, approximately 100 shoots of pre-discharges are good enough to execute a recovery of the kind. With the adoption of the head of the present invention, it is possible to shorten the time required for recovery, and also, to reduce the liquid loss caused by the execution of such a heave recovery. This means that with the adoption of the present invention, running costs are also reduced significantly.

Also, particularly with the structure of the present invention that contributes to improving the refilling aspect of the operation, it is possible to attain the provision of good response to a continuous discharging, the stabilized development of air bubbles, and the droplet stabilization as well. Therefore, the performance of a high-speed recording is possible, while obtaining recorded images in high quality by discharging liquid stably at high speed.

Particularly, in accordance with the present invention, the structure is arranged so that the free end of the movable member is slightly displaced to the ceiling side of the liquid flow path when operation is at rest, making it possible to reduce the load to the movable member at the time of initiating its operation. This arrangement contributes to discharging liquid efficiently.

This arrangement also enables the movable member to be displaced in good condition for discharging even when the viscosity coefficient of ink increases under the lower temperature environment or the like.

From the description of each embodiment, the other effects of the present invention should be understandable.

In this respect, the term "upstream" and the term "downstream" referred to in the description of the present invention are used to represent them in the direction of liquid flow from its supply source to the discharge port by way of the air bubble generating area (or the movable member) or to express them with respect to the structural directions related to such liquid flow.

Also, the term "downstream side" with respect to the air bubble itself is defined to represent the portion of the air bubble on the discharge port side, which chiefly acts upon the discharge of droplets directly. More specifically, it means the downstream side of the center of the air bubble with respect to the aforesaid direction of liquid flow and the structural direction thereof or it means the air bubble created on the area on the downstream side of the center of the area of the heat generating element.

Further, the term "separation wall" referred to in the description of the present invention means the wall (that may include the movable member) in its broad sense, which lies to partition the air bubble generating area and the area conductively connected with the discharge port directly, and in its narrow sense, it means the wall that partitions the flow path including the air bubble generating area and the liquid flow path conductively connected with the discharge port for the prevention of liquids residing each of the areas from being mixed.

Also, the term "discharge port formation area" means the discharge port, the edge portion that forms the discharge port, the inner surface of the discharge port, the surface where the discharge port portion and liquid flow path are connected, and the area of the end portion of the liquid flow path including the aforesaid surface.

BRIEF DESCRIPTION OF THE DRAWINGS

FIG. 10A is a cross-sectional view schematically showing a liquid jet head, taken in the liquid flow path direction; and FIGS. 10B to 10D are cross-sectional views, taken along line a—a in FIG. 10A.

DETAILED DESCRIPTION OF THE PREFERRED EMBODIMENTS

Embodiment 1

Figure 1A:
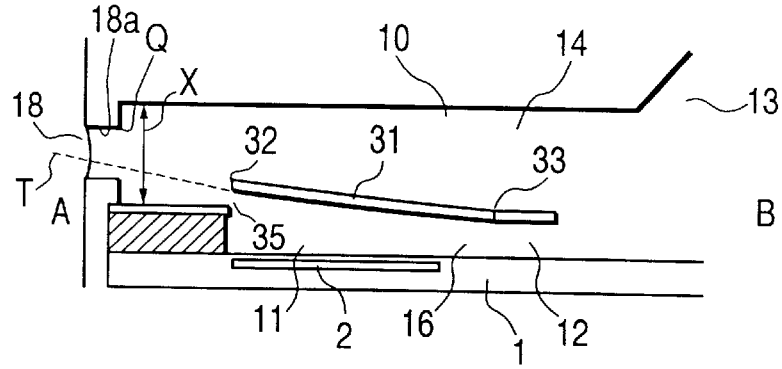
FIGS. 1A, 1B, 1C, and 1D are cross-sectional views which illustrate a liquid jet head in accordance with a first embodiment of the present invention.

Hereinafter, with reference to the accompanying drawings, the detailed description will be made of a first embodiment in accordance with the present invention.

At first, for the present embodiment, an example will be described, in which the enhancement of discharging power and discharging efficiency are attempted by controlling the propagating direction of pressure exerted by the creation of each air bubble, and the developing direction of the air bubble as well.

FIGS. 1A to 1D are cross-sectional views which schematically illustrate the liquid jet head of the present embodiment, taken in the liquid flow path thereof. FIG. 2 is a partially broken perspective view which shows such liquid jet head.

For the liquid jet head of the present embodiment, the heat generating elements 2 (each in the form of heat generating resistor of 40 $\mu$m×105 $\mu$m in accordance with the present embodiment), which cause thermal energy to act upon liquid as discharge energy generating elements, are arranged on the elemental substrate 1 for discharging liquid. The liquid flow paths 10 are arranged on the elemental substrate 1 corresponding to the heat generating elements 2. Each of the liquid flow paths 10 is conductively connected with the discharge port 18, and at the same time, connected with the common liquid chamber 13 that supplies liquid to a plurality of liquid flow paths 10, and receives liquid from the common liquid chamber 13 in an amount corresponding to the amount of the droplet that has been discharged.

On the elemental substrate 1 having each liquid flow path 10, a plate type movable member 31 provided with a flat portion, which is formed by an elastic metal or the like, is arranged in a cantilever fashion to substantially face the heat generating element 2. One end of the movable member 31 is fixed to a base (a supporting member) 34 or the like formed by patterning a photosensitive resin or the like applied to the all of the liquid flow path 10 and the elemental substrate 1. In this way, the movable member 31 is held, and also, a fulcrum (fulcrum portion) 33 is structured.

The movable member 31 has the fulcrum (fulcrum portion:fixed end) 33 on the upstream side of the large flow running from the common liquid chamber 13 to the discharge port 18 side through the movable member 31 when operating liquid discharge, and the free end (free end portion) 32 on the downstream side with respect to the fulcrum 33.

Figure 2:
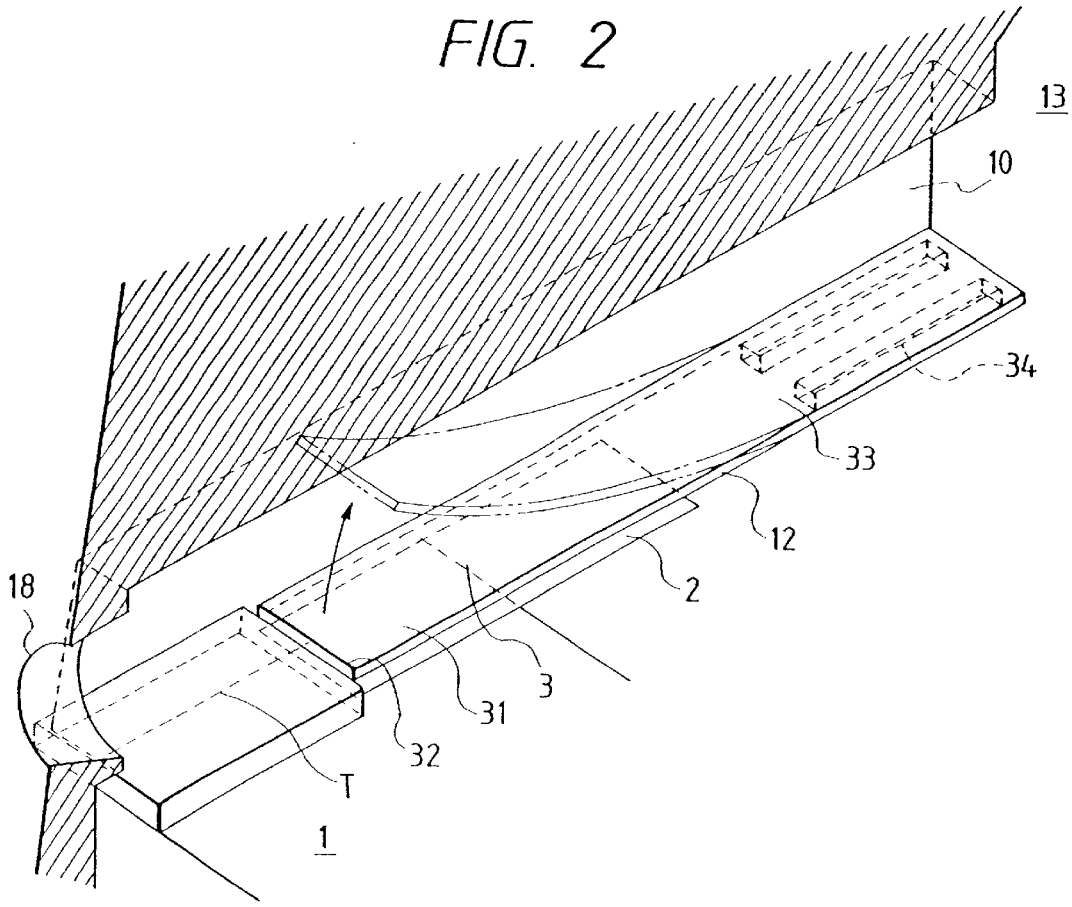
FIG. 2 is a partially broken perspective view which shows the liquid jet head of the present invention.

The free end 32 of the movable member 31 is slightly displaced to the liquid flow path 10 side before foaming (that is, the state that no heat generating element is driven; or it is at rest) as shown in FIG. 1A. In other words, before foaming, the free end 32 of the movable member 31 may be considered to be inclined at a given angle with respect to the elemental substrate 1 having the heat generating element arranged therefor. By this inclination of the free end 32, the movable member 31 itself is inclined, thus making it possible to present an advantage that the initial discharging performance (that is, the so-called mon-discharging property) is enhanced, because the load given to the movable member 31 is reduced when it pushes back liquid residing above the movable member 31 by means of foaming pressure exerted on the area (hereinafter referred to as an air bubble generating area) 11 where the air bubble is created abruptly in liquid by the application of heat of the heat generating element 2. Also, if the position of the free end 32 is too high, the concentration effect of pressure in the direction of the discharge port 18 is reduced or the refilling performance of liquid from the common liquid chamber 13 to the liquid flow path 10 is inevitably reduced by such inclination of the movable member 31. Therefore, the degree of the inclination of the movable member is determined comprehensively in consideration of the provision of the advantage described above, and these effects that may be reduced if not properly controlled. Here, in accordance with the present invention, the movable member is inclined to position its free end so that the air bubble generating area is open partly toward the discharge port, and that the tangential line on the side face of the air bubble generating area or the extend line of the free end portion of the movable member 31 reaches directly the inner surface (X) of the discharge port formation area on the liquid flow path side (as indicated by a dotted line T).

In this respect, as the value of opening as described above, it is desirable to set the height of the free end at 5 $\mu$m or more with respect to the fulcrum, and preferably, it is 30 $\mu$m or less.

Further, preferably, the intersecting point between the extended line from the line that connects the fulcrum 33 and free end 32 of the movable member before foaming, and the inner surface 18*a* of the discharge port portion having the discharge port 18 is positioned lower than the uppermost end position Q of the inner surface 18*a*. More preferably, the free end 32 of the movable member 31 before foaming should be arranged to be inclined on the liquid flow path 10 side, which is conductively connected with the discharge port 18, so that the aforesaid intersecting point is positioned lower than the central point of the inner surface 18*a*.

In this respect, the heat generating element 2 formed on the elemental substrate 1, which substantially face the movable member 31 slightly displaced to the liquid flow path 10 side, is arranged to be included within the projection area of the movable member 31 thus displaced. In other words, it is desirable to overlap the projected line segment of the movable member to the elemental substrate 1 (the sectional line segment of the movable member in the direction of liquid flow path) with the line segment of the heat generating element 2 when observed on the sectional surface in the direction of liquid flow path. With the structure thus arranged, it becomes possible for the movable member 31 to receive the pressure of the air bubble generated by heat of the heat generating element 2 efficiently, and lead it to the discharge port 18 side.

Also, the heat generating element is not necessarily provided for the movable member 31 in the mode of one to one arrangement. As described later, it may be possible to arrange one movable member 31 with respect to two or more heat generating elements. When plural heat generating elements are provided, it is possible to change the foaming pressure exerted on the movable member 31 by driving each of the heat generating elements individually or together at a time.

Also, it may be possible to arrange an upper limit stopper to regulate the upper limit of the displacement for the movable member at the time of foaming, or arrange a lower limit stopper to regulate its lower limit.

From the surface of the elemental substrate where the heat generating elements are arranged to the fulcrum of the movable member 31 forms a gap of approximately 15 $\mu$m when structured. The space thus formed between the heat generating element and the movable member includes the air bubble generating area 11 as described above. The air bubble generating area 11 is formed between the surface of the elemental substrate 1 and the virtual surface, which is parallel to such surface and which includes the fulcrum 31 of the movable member 33.

In this respect, the kinds, configurations, and arrangements of the heat generating element and movable member are not necessarily limited to those described above. As described later, it should be good enough if only the heat generating element and movable member are configured and arranged to be able to control the development of each air bubble and the propagation of pressure.

Here, in order to illustrate the flow of liquid which will be taken up later, the flow path 10 will be described by separating it into a first flow path 14 that is directly and conductively connected with the discharge port 18, and a second flow path 16 provided with the air bubble generating area 11 and the liquid sully path 12 as well, having the movable member 31 as the boundary between them.

Figure 1B:
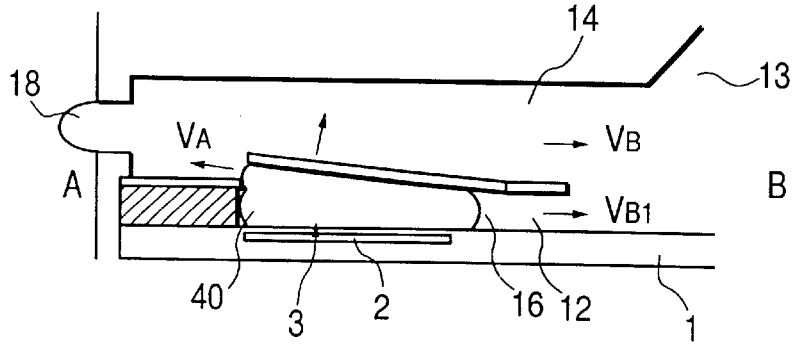
Figure 1C:
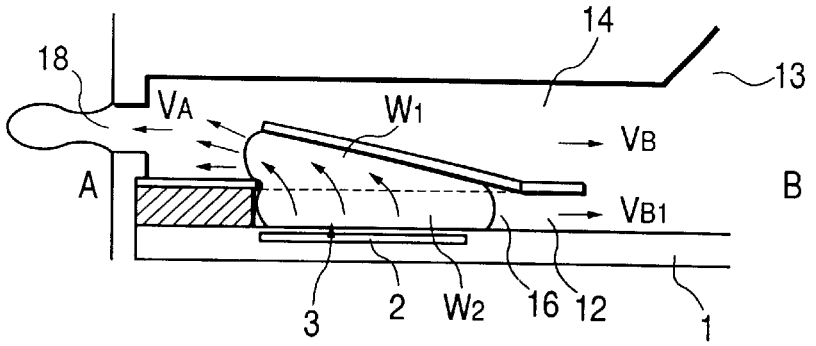

The heat generating element 2 is actuated to cause heat to act upon liquid on the air bubble generating area existing between the movable member 31 and the heat generating element 2, thus creating each of the air bubbles in liquid by means of film boiling phenomenon such as disclosed in the specification of U.S. Pat. No. 4,723,129. The pressure thus exerted by the creation of the air bubble, and the air bubble itself act upon the movable member 31 priorly. The movable member 31 is displaced to be open largely on the discharge port side centering on the fulcrum 33 as shown in FIGS. 1B, and 1C or in FIG. 2. By the further displacement of the movable member 31 or by the displaced state thereof, the pressure exerted by the creation of the air bubble and the development of the air bubble itself are led to the discharge port side.

Here, the description will be made of one of the fundamental principles of discharge, which is applied to the present invention. For the present invention, one of the most important principles is that the movable member that is arranged to face the air bubble is to be displaced from a first position where the movable member usually resides to a second position where it resides after displacement, and by means of the movable member 31 capable of being displaced like this, the pressure exerted by the creation of each air bubble and the air bubble itself are led toward the downstream side where the discharge ports 18 are arranged.

This principle of discharge will be described further in detail with the comparison between FIG. 3 which schematically shows the conventional structure of liquid flow path without using any movable member, and FIG. 4 which schematically shows the structure of liquid flow path using the movable member as described above. Here, the propagating direction of pressure toward the discharge port is designated by a reference mark VA, and the propagating direction of pressure toward the upstream side as VB.

Figure 3:
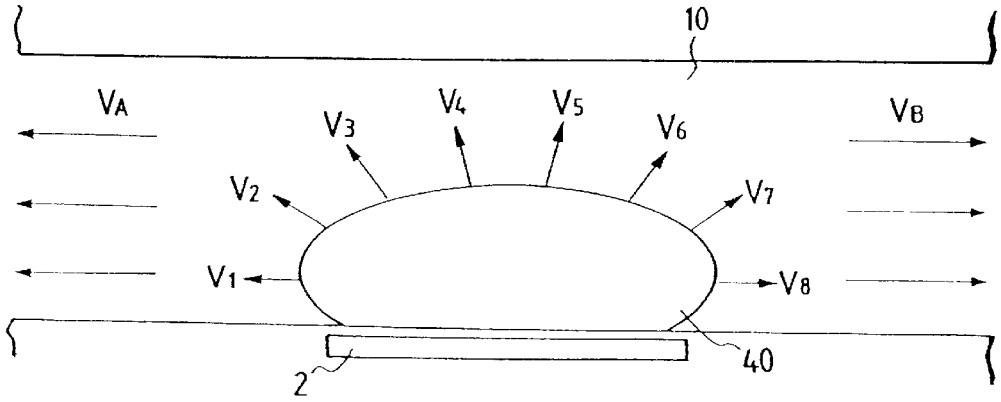
FIG. 3 Prior Art
FIG. 3 is a view which schematically shows the propagation of pressure exerted by an air bubble in the conventional head.

As shown in FIG. 3, the conventional head is not provided with any structure that regulates the propagating direction of pressure exerted by the created air bubble 40. As a result, the directions of pressure exerted by the air bubble 40 become perpendicular to the surface of the air bubble as indicated by the reference marks V1 to V8, and it is propagated in various directions accordingly. Of these directions, those having the component in the pressure propagating directions toward the VA which affects the liquid discharge most, are designated by the marks V1 to V4, that is, the components in the pressure propagating directions near the discharge port from the position almost half of the air bubble. These are in the important portions that contribute directly to the effectiveness of discharging efficiency, discharging power, and discharging speed. Further, the one designated by the mark V1 functions efficiently because it is nearest to the discharging direction VA. On the contrary, the one designated by the mark V4 contains a comparatively small directional component toward VA.

Figure 4:
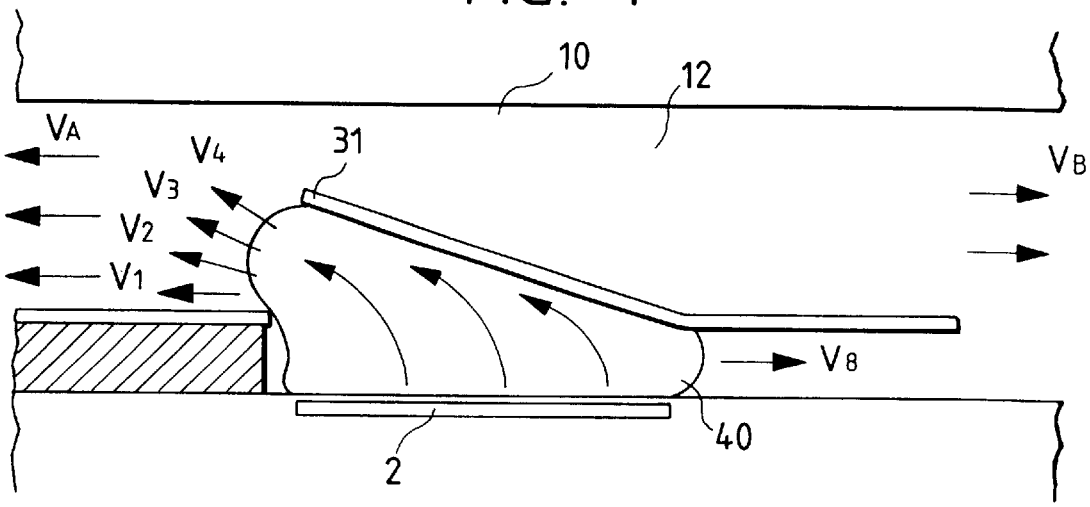
FIG. 4 is a view which schematically shows the propagation of pressure exerted by an air bubble in the head of the present invention.

Compared to this structural arrangement, the provision of the movable member as shown in FIG. 4 in accordance with the principle described above makes it possible to lead the pressure propagating directions of the air bubble, which are orientated in the various directions V1 to V4 in the conventional case shown in FIG. 3, toward the downstream side (discharge port side) by means of the movable member 31, and let them change into the pressure propagating directions designated by the reference mark VA, thus enabling the pressure exerted by the air bubble 40 to contribute directly and more efficiently to discharging. Then, the developing direction of the air bubble itself is led in the downstream direction as in the pressure being propagated in the directions V1 to V4. As a result, the air bubble is developed larger in the downstream side than in the upstream side. In this way, the developing direction of the air bubble itself is controlled by means of the movable member 31. Also, the pressure propagating directions of the air bubble are controlled likewise, hence making it possible to attain the fundamental enhancement of the discharging efficiency, discharging power, and discharging speed, among others.

Now, reverting to FIGS. 1A to 1D, the discharging operation of the liquid jet head of the present embodiment will be described in detail.

FIG. 1A shows a state before electric energy or some other energy is applied to a heat generating element 2. The heat generating element 2 is in a state before it generates heat. What is important here is that the free end 32 of the movable member 31 is slightly displaced to the liquid flow path 10 side, and that the movable member 31 is arranged in a position to face at least the portion of an air bubble on its downstream side with respect to the air bubble 40 created by the heating of the heat generating element 2. In other words, the movable member 31 is arranged at least in a position on the downstream of the center 3 of the area of the heat generating element in the structure of the liquid flow path (that is, the downstream of a line perpendicular to the longitudinal direction of liquid flow path, which passes the center 3 of the area of the heat generating element) so that the downstream side of the air bubble 40 can act upon the movable member.

FIG. 1B shows a state that electric energy or some other energy is applied to the heat generating element 2 to enable the heat generating element 2 to be heated, and then, liquid filled on the air bubble generating area 11 is partly heated by the heat thus generated, thus creating the air bubble following film boiling.

At this juncture, the movable member 31 is displaced from the first position, in which the movable member is slightly displaced to the liquid flow path 10 side, to the second position by means of pressure exerted by the creation of the air bubble 40 so as to lead the propagating direction of the pressure of the air bubble 40 in the direction of the discharge port. What is important here is that, as described above, the free end 32 of the movable member 31 is arranged on the downstream side (discharge port side), while the fulcrum 33 is arranged in a position on the upstream side (common liquid chamber side) so that at least a part of the movable member 31 is brought to face the downstream portion of the heat generating element 2, that is, the downstream portion of the air bubble 40, and that the movable member 31 is displaced to the liquid flow path 10 side in advance, while the operation is at rest before the creation of the air bubble. With this arrangement, it becomes possible to make the load to the movable member 31 smaller when the movable member 31 pushes back liquid residing on it in the liquid flow-path 30 by means of the foaming pressure exerted at the time of the operation thereof.

FIG. 1C shows a state that the air bubble 40 is further developed. Here, in accordance with the pressure following the creation of the air bubble 40, the movable member 31 is further displaced. The air bubble 40 thus created is developed larger on the downstream than the upstream, and at the same time, it is developed larger still beyond the first position of the movable member 31 (the position indicated by a dotted line). In this way, as the air bubble 40 is being developed, the movable member 31 is gradually displaced. Thus, it becomes possible to lead the developing direction of the air bubble toward the direction in which the pressure propagating direction of the air bubble 40 and its voluminal shift are easily effectuated. In other words, the developing direction of the air bubble toward the free end side is orientated to the discharge port 18 evenly. This is considered to be a factor that contributes to the enhancement of the discharging efficiency. The movable member 31 presents almost no obstacle in propagating the pressure waves in the direction of the discharge port following the air bubble or the creation of the air bubble. The propagating direction of the pressure and the developing direction of the air bubble can be controlled efficiently corresponding to the magnitude of the pressure to be propagated.

Figure 1D:
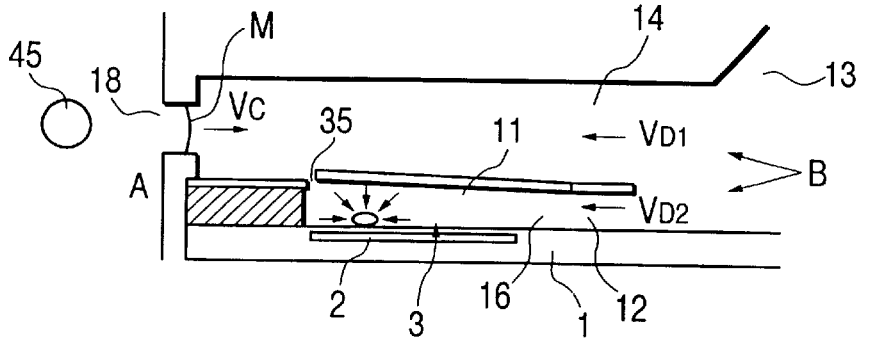

FIG. 1D shows the air bubble 40 is contracted due to the reduction of the pressure in the air bubble subsequent to the film boiling described above.

The movable member 31, which is displaced to the second position, is returned to the initial position shown in FIG. 1A (the first position) by means of the negative pressure exerted by the contraction of the air bubble and the restoring force provided by the spring of the movable member 31 itself as well. Also, when the air bubble disappears, liquid is caused to flow in from the upstream side (B), that is, from the common liquid chamber side as the flows of liquid designated by reference marks VD1 and VD2, and also, from the discharge port side as designated by Vc, in order to make up the contracted volume of the air bubble on the air bubble generating area 11, as well as the voluminal portion of liquid that has been discharged.

Now, the description has been made of the operation of the movable member following the creation of an air bubble, and also, of the discharging operation of liquid. Hereinafter, the detailed description will be made of the liquid refilling for the liquid jet head of the present invention.

Now, using FIGS. 1A to 1D the liquid supply mechanism of the present invention will be described further in detail.

Following the state shown in FIG. 1C, the air bubble 40 enters the defoaming process after its volume becomes the greatest. At this juncture, liquid that makes up the volume that has been reduced due to defoaming is caused to flow in the air bubble generating area 11 from the discharge port 18 side of a first liquid flow path 14 and from the common liquid chamber 13 side of a second liquid flow path 16 as well. For the conventional liquid flow structure that does not contain any movable member 31, the amount of liquid flowing in the defoaming position from the discharge port side and the liquid amount flowing in from the common liquid chamber are determined by the magnitude of flow resistance between the portion nearer to the discharge port than to the air bubble generating area and the portion nearer to the common liquid chamber (that is, determined by the flow resistance and the inertia).

Therefore, if the flow resistance is smaller on the side near to the discharge port, a large amount of liquid flows in the defoaming position from the discharge port side, which makes the regressive amount of meniscus greater. Particularly when the flow resistance on the side nearer to the discharge port is made smaller in order to enhance the discharging efficiency, the regressive amount of meniscus M becomes greater. As a result, it takes more time to execute refilling, which hinders a higher speed printing.

In contrast, since the movable member 31 is arranged for the liquid jet head of the present embodiment, the regression of the meniscus should come to a stop when the movable member 31 returns to the original position at the time of defoaming, provided that the upper side of the volume W of the air bubble is given as W1 with the first position being defined as the boundary, and the air bubble generating area 11 side as W2. After that, the voluminal portion of the liquid supply for the remaining W2 is made up by the liquid supply from the flow VD2, which is mainly from the second liquid flow path. In this way, whereas the regressive amount of the meniscus becomes as large as almost a half of the volume of the air bubble W conventionally, it is possible to suppress the regressive amount of the meniscus to almost a half of the W1, which is already smaller than the conventional backward amount of the meniscus.

Further, the liquid supply for the voluminal portion W2 can be executed compulsorily mainly from the upstream side (VD2) of the second liquid flow path 16 along the surface of the movable member 31 on the heat generating side. Therefore, refilling can be implemented at a higher speed.

Here, characteristically, when refilling is executed using the pressure exerted at the time of deforming for the conventional head, the vibration of meniscus becomes great, leading to the degrading of image quality. However, with the high-speed refilling described above, it is possible to make the vibration of the meniscus extremely small, because the liquid flow is suppressed on the area of the first liquid flow path 14 on the discharge port side and the air bubble generating area 11 on the discharge port side as well.

Thus, With the present invention, it is possible to attain the compulsory refilling to the air bubble generating area 11 through the second liquid flow path 16 of the liquid supply path 12, and also, attain a high-speed refilling by suppressing the regression and vibration of the meniscus. Therefore, the stabilized discharges and a high-speed repetition of discharges can be implemented. Also, when applying it to recording, the enhancement of image quality and high-speed recording are made possible.

Further, the structure as arranged in accordance with the present invention provides the effective functions dually as given below. In other words, it is possible to suppress the propagation of pressure exerted by the creation of the air bubble to the upstream side (that is, back waves). Conventionally, in an air bubble created on a heat generating element, most of the pressure exerted by the air bubble on the common liquid chamber side (upstream side) becomes a force (the back waves) that pushes back liquid to the upstream side. The back waves bring about not only the pressure on the upstream side, but also, the shifting amount of liquid caused thereby, and then, the inertia following such shifting of liquid. This event results in the unfavorable performance of liquid refilling into the liquid flow paths, leading also to the hindrance of high-speed driving. In accordance with the present invention, such action working upon the upstream side is suppressed at first by means of the movable member 31. Then, it is made possible to enhance the performance of refilling supply more.

Now, the description will be made of the structures and effects more characteristic to the present embodiment.

The second liquid flow path 16 of the present embodiment is provided with a liquid supply path 12 having the inner wall (with the surface of the heat generating element does not fall down remarkably), which is essentially connected with the heat generating element flatly on the upstream of the heat generating element. In this case, the liquid supply to the air bubble generating area and to the surface of the heat generating element 2 is executed as indicated by the reference mark VD2 along the surface on the side nearer to the air bubble generating area 11 of the movable member 31. As a result, the stagnation of liquid on the surface of the heat generating element 2 is suppressed to make it possible to easily remove the deposition of gas remaining in liquid, as well as the so-called remaining bubbles yet to be defoamed. Also, there is no possibility that the heat accumulation on liquid becomes too high. Therefore, it is possible to perform more stabilized creation of air bubbles repeatedly at high speeds. In this respect, the description has been made of the liquid supply path 12 having an inner wall, which is essentially flat, but the present invention is not necessarily limited to it. It should be good enough if only the liquid supply path has a smooth inner wall connected with the surface of the heat generating element smoothly, and is configured so that there is no possibility that liquid is stagnated on each of the heat generating elements and that any large disturbance of flow takes place in supplying liquid.

Also, the liquid supply to the air bubble generating area is executed from the VD1 through the side portion (slit 35) of the movable member. However, in order to lead the pressure toward the discharge port more effectively when each of the air bubbles is created, a large movable member is adopted to cover the entire area of the air bubble generating area (to cover the surface of the heat generating element totally) as shown in FIGS. 1A to 1D. In this case, the liquid flow from the VD1 to the air bubble generating area 11 may be blocked if the mode is such that the flow resistance between the air bubble generating area 11 and the area near to the discharge port on the first liquid flow path 14 becomes larger when the movable member 31 returns to the first position. For the head structure of the present embodiment, the flow VD1 is available for liquid supply to the air bubble generating area. As a result, the liquid supply performance becomes extremely high, and there is no possibility that the liquid supply performance is lowered even if the structure is arranged so that the removable member 31 covers the air bubble generating area 11 totally for the enhancement of discharging efficiency.

Figure 5:
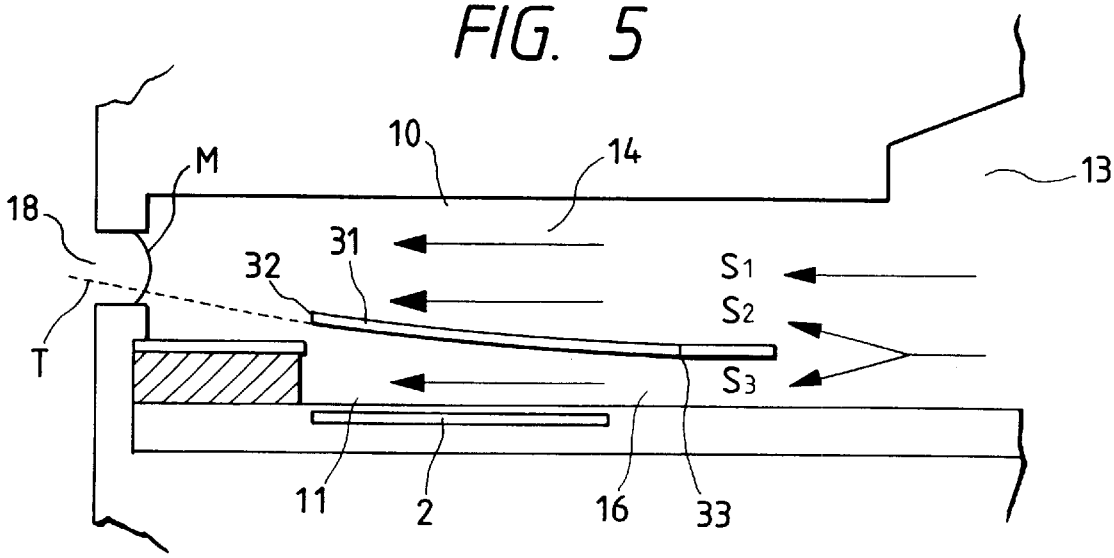
FIG. 5 is a view which schematically illustrates the flow of liquid in accordance with the present invention.

Now, as to the positions of the free end 32 of the movable member 31 and the fulcrum 33, it is arranged that the free end is relatively on the downstream side than the fulcrum as shown in FIG. 5. Since the structure is arranged in this way, it becomes possible to implement the function to lead the pressure propagating direction and developing direction of the air bubble toward the discharge port side effectively when foaming is effectuated as described earlier. Further, with this positional relationship, it is made possible to produce not only favorable effects on the discharging functions, but also, make the flow resistance smaller for liquid running in the liquid flow path 10 at the time of supplying liquid, thus obtaining the effect that refilling is possible at higher speeds. This is because, as shown in FIG. 5, the free end and the fulcrum 33 are arranged not to present resistance to the flows S1, S2, and S3 running in the liquid flow path 10 (including the first liquid flow path 14 and the second liquid flow path 16) along the meniscus M, which has regressed due to discharging, returning to the discharge port 18 by means of capillary force or along liquid supply being supplied subsequent to defoaming. In this respect, for the present invention, the movable member 31 is displaced to the first liquid flow 14 side when the operation is at rest. Therefore, at the time of refilling liquid to the first liquid flow path 14, the movable member 31 presents resistance to the liquid flow. However, since the liquid flows S1 and S2 are such as to flow in the direction to make the inclination of the movable member smaller, the resistance is so small that does not hinder the refilling operation.

To supplement this, as shown in FIGS. 1A to 1D, the free end 32 of the movable member 31 extends over the heat generating element 2 to face the downstream side of the center 3 of the area (that is the line perpendicular to the longitudinal direction of the liquid flow path, passing the center (central portion) of the area of the heat generating element), which divides the heat generating element 2 into the upstream side and the downstream side. In this way, the pressure generated on the downstream side of the central position 3 of the heat generating element, which contributes greatly to liquid discharging, or the air bubble, is received by the movable member 31. Thus, the pressure and air bubble are led to the discharge port side for the fundamental enhancement of the discharging efficiency and discharging power.

Further, the upstream side of the air bubble is also utilized to produce many favorable effects.

Also, with the structure of the present embodiment, the free end of the movable member 31 effectuates a mechanical displacement instantaneously. This function is also considered to contribute effectively to discharging liquid.

Embodiment 2

Hereinafter, with reference to the accompanying drawings, the description will be made of a second embodiment in accordance with the present invention.

For the present embodiment, the main principle of liquid discharge is also the same as the one adopted for the previous embodiment. In accordance with the present embodiment, the liquid flow path is arranged as a structure having plural flow paths, and by the application of heat, it becomes possible to separate liquid into one for use of foaming (foaming liquid) and the other mainly for use of discharging (discharging liquid).

Figure 6:
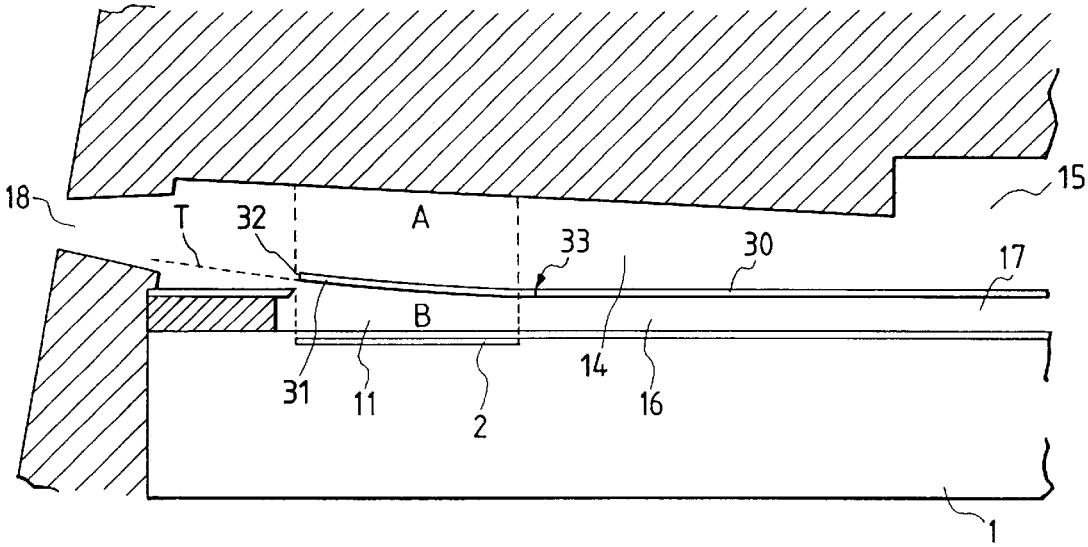
FIG. 6 is a cross-sectional view schematically showing the direction of flow paths of a liquid jet head in accordance with a second embodiment of the present invention.
Figure 7:
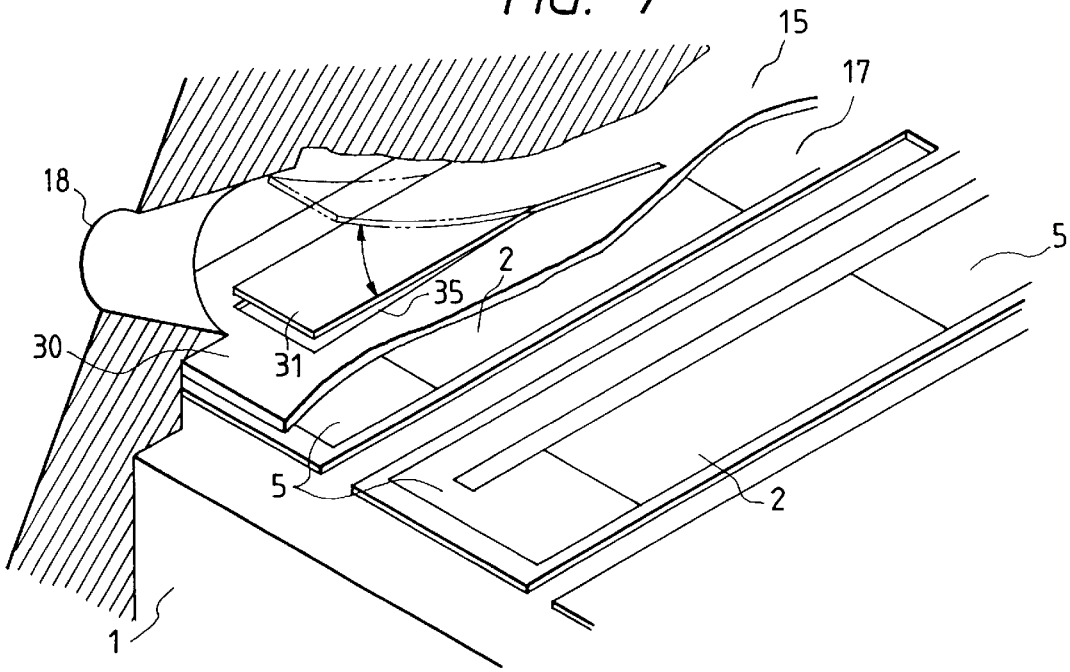
FIG. 7 is a partially broken perspective view which shows the liquid jet head represented in FIG. 6.

FIG. 6 is a cross-sectional view schematically showing the liquid jet head of the present embodiment, taken in the flow path direction thereof. FIG. 7 is a partially broken perspective view which shows the liquid jet head represented in FIG. 6.

For the liquid jet head of the present embodiment, each of the second liquid flow paths 16 for use of foaming is arranged on the elemental substrate 1 having the heat generating elements 2 arranged therefor to give thermal energy to liquid to cause it to create air bubbles, and on it, each of the first liquid flow paths 14 for use of discharging liquid is arranged, which is directly and conductively connected with each of the discharge ports 18.

The upstream side of the first liquid flow path is conductively connected with the first common liquid chamber 15 for supplying liquid to a plurality of first liquid flow paths. The upstream side of the second liquid flow path is conductively connected with the second common liquid chamber for supplying foaming liquid to a plurality of second liquid flow paths.

However, if the same liquid is used as foaming liquid and discharging liquid, it may be possible to arrange one common liquid chamber for sharable use.

Between the first and second liquid flow paths, a separation wall 30, which is formed by elastic metal or the like, is arranged to partition the first liquid flow path and the second liquid flow path. Here, for use of the liquid, for which foaming liquid and discharging liquid should not be mixed as far as the circumstances permit, it is preferable to separate the distributions of liquid completely for the first liquid flow path 14 and the second liquid flow path 16 as much as possible. However, there is no problem even if foaming liquid and discharging liquid are mixed to a certain extent, it may be unnecessary to provide the separation wall with the function to separate them completely.

The portion of the separation wall, which is positioned in the projection space formed upward in the surface direction of the heat generating element (hereinafter referred to as discharge pressure generating area; the area at A and the air bubble generating area 11 at B in FIG. 6), is arranged to be in the form of a movable member 31 held in a cantilever fashion having its free end on the discharge port side (on the downstream side of the liquid flow) by means of a slit 35, and its fulcrum 33 on the common liquid chambers (15 and 17) side. Since the movable member 31 is arranged to face the air bubble generating area 11 (B), it operates to be open toward the discharge port side of the first liquid flow path side by foaming of the foaming liquid (that is, in the direction indicated by an arrow in FIG. 6). In FIG. 7, too, on the elemental substrate 1, which is provided with the heat generating resistive unit serving as a heat generating element 2, and a wire electrode unit 5 to apply electric signals to the heat generating resistive unit, the separation wall 30 is arranged through the space that constitutes the second liquid flow path.

The arrangement of the fulcrum 33 and free end 32 of the movable member 31, and the arrangement of the heat generating element are the same as those in the previous embodiment.

Also, for the previous embodiment, the description is made for the structural relationship between the liquid supply path 12 and the heat generating element 2. For the present embodiment, the structural relationship between the second liquid flow path 16 and the heat generating element 2 is made in the same manner as in the previous one.

Further, since the head structured in accordance with the present invention produces those effects as described in the previous embodiment, the adoption of the present embodiment makes it possible to discharge liquid with higher discharging efficiency and higher discharging power.

Hereinafter, with reference to FIGS. 8A to 8G, the description will be made of the driving status when liquid is discharged by use of the liquid jet head of two-flow path mode in accordance with the present invention. Here, in order to drive the head, ink of the same water type is adopted for driving as discharging liquid supplied to the first liquid flow path 14 and as foaming liquid supplied to the second liquid flow path 16.

Figure 8A:
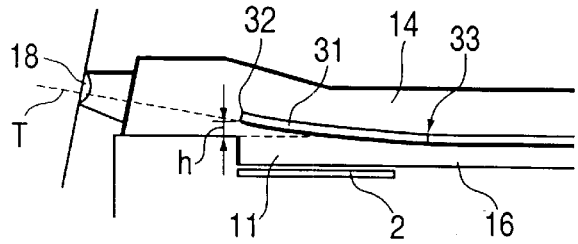
FIGS. 8A, 8B, 8C, 8D, 8E, 8F and 8G are cross-sectional views which illustrate, respectively, the driving status of liquid discharge using a liquid jet head provided with the two-flow path mode of the present invention.

For the present invention, the free end 32 of the movable member 31 is displaced as shown in FIG. 8A by a distance of h from the air bubble generating area 11 when the operation is at rest (in the state that the heat generating element is not driven). Thus, the first liquid flow path 14 and the second liquid flow path 16 are conductively connected on the free end 32 side.

Figure 8B:
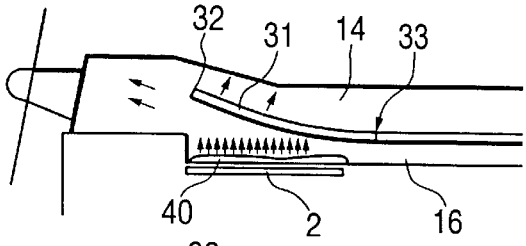
Figure 8C:
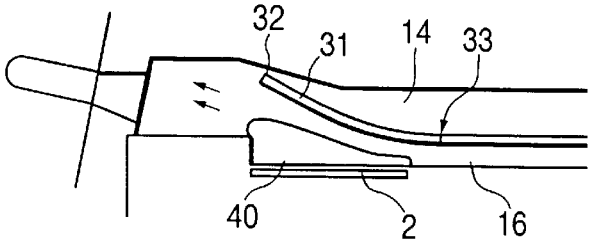

Then, as shown in FIG. 8B and FIG. 8C, the air bubble is created by means of film boiling phenomenon brought about in foaming liquid on the air bubble generating area 11 on the heat generating element 2 as disclosed in U.S. Pat. No. 4,723,129 in accordance with thermal energy generated by the heat generating element 2 when it is driven as referred to in the description of the previous embodiment. By means of pressure exerted by this foaming, the free end 32 of the movable member 31 is further displaced to the first liquid flow path 14 side.

Figure 8D:
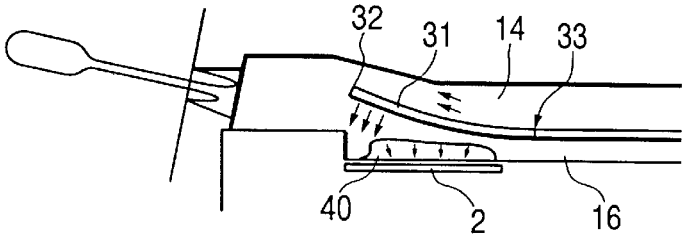
Figure 8E:
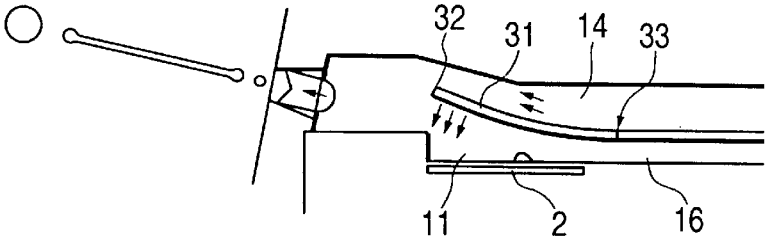

Subsequently, as shown in FIG. 8D and FIG. 8E, a specific amount of liquid (discharging liquid) is discharged externally from the discharge port 18 by the same action as in the previous embodiment. At the time of defoaming, liquid (foaming liquid) is supplied from the upstream of the second liquid flow path 16 onto the heat generating element 2. At the same time, liquid (discharging liquid) on the discharge port side is sucked in from the free end 32 of the movable member 31 onto the heat generating element 2. Thus, liquid (discharging liquid) is supplied from the upstream of the first liquid flow path 14 to the discharge port 18 side of the free end 32.

Figure 8F:
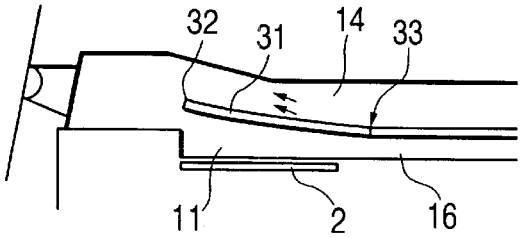
Figure 8G:
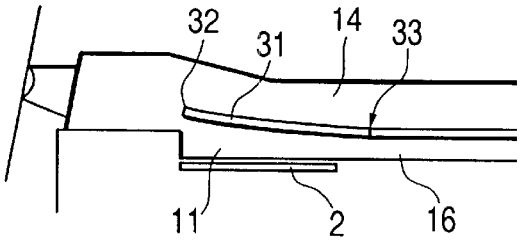

As shown in FIG. 8F and FIG. 8G, the free end 32 of the movable member 31 is displaced once to a position nearer to the air bubble generating area than the initial position (that is, the position where the height of the free end of the movable member is h from the air bubble generating area) due to the supply of liquid (discharging liquid) to the discharge port side of the free end 32, and then, the free end of the movable member returns to the initial position lastly. Here, also, for the present embodiment, the supply of discharging liquid is performed in the direction of the inclination of the movable member being reduced as in the previous embodiment. Therefore, the refilling of discharging liquid is not hindered by the presence of the movable member.

The functions and effects of the main parts related to the propagation of foaming pressure following the displacement of the movable member, the developing direction of the air bubble, the prevention of back waves, and others are the same as those of the first embodiment and others previously described.

Particularly, for the present embodiment, since the free end 32 of the movable member 31 is displaced to the first liquid flow path side when driving is at rest, it is possible to reduce the push-up load exerted on the movable member at the time of driving, which is needed for leading foaming liquid to the discharge port 18, and also, for pushing up discharging liquid that resides over the movable member 31 when the foaming pressure is to the movable member from the air bubble generating area 11. With this reduction of the initial load exerted on the movable member, the foaming pressure is led to the discharge port 18 efficiently to make the enhancement of the discharging efficiency possible.

Embodiment 3

Figure 9A:
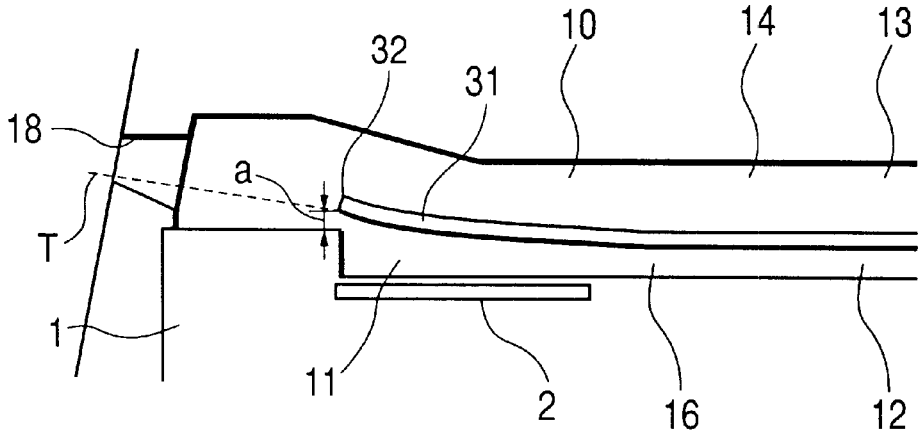
FIGS. 9A and 9B are cross-sectional views which schematically illustrate a third embodiment in accordance with the present invention.
Figure 9B:
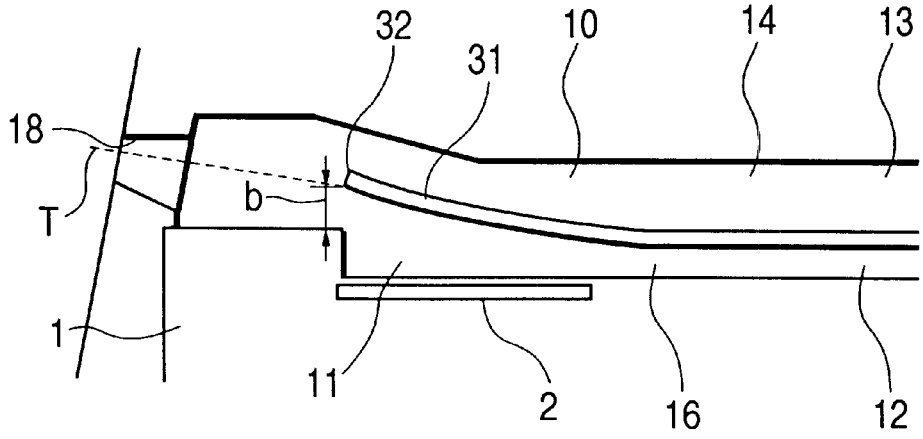

FIGS. 9A and 9B are cross-sectional views which schematically illustrate a third embodiment in accordance with the present invention. The special feature of the present embodiment is that the movable member 31 is formed by material capable of being deformed depending on temperatures.

In accordance with the present embodiment, when the temperature of the head is lowered, the displacement of the free end 32 of the movable member 31 is made larger at the time of operation (driving) at rest as shown in FIGS. 9A and 9B in order to reduce the load given to the movable member 31 for its initial operation. This arrangement is needed because the viscosity of liquid (discharging liquid) is raised when the head temperature is lowered. In this respect, the relationship between distances designated by marks a and b for the free end 32 and the air bubble generating area is made to satisfy an inequality of a<b as shown in FIGS. 9A and 9B.

In order to displace the free end 32 of the movable member 31 depending on temperatures as described above, it may be possible to form the movable member 31 by a bimetal material produced by at least two kinds of plates each having different thermal expansion coefficient, and bonded together or a shape memory material having such property as to sense a specific temperature and change an angle of inclination, for example.

Also, in the state of holding the movable member before the creation of the air bubble, the movable member is placed in a position not to allow the air bubble generating area to be open, and immediately before the air bubble is created, the bimetal is actuated to release the air bubble generating area. In this way, the recording operation is kept in the standby condition. Then, it is possible to essentially separate different liquids each for use of the first liquid flow path and the second liquid flow in this state before foaming.

In accordance with the present embodiment, the displacement condition of the movable member is made changeable in accordance with the viscosity of liquid depending on the head temperatures. Therefore, it is possible to obtain a liquid jet head usable in two modes, one for operation at low temperatures and the other for operation at high temperatures.

Embodiment 4

Figure 10A:
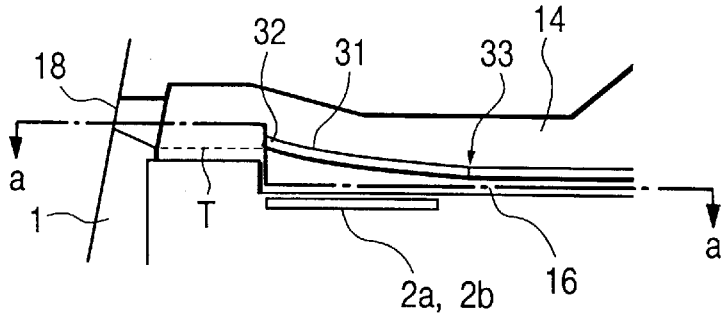
FIGS. 10A, 10B, 10C and 10D are cross-sectional views which illustrate a fourth embodiment in accordance with the present invention.
Figure 10B:
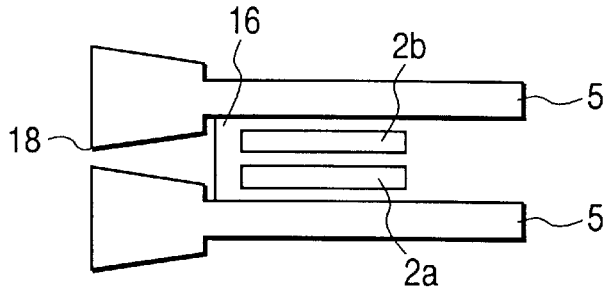
Figure 10C:
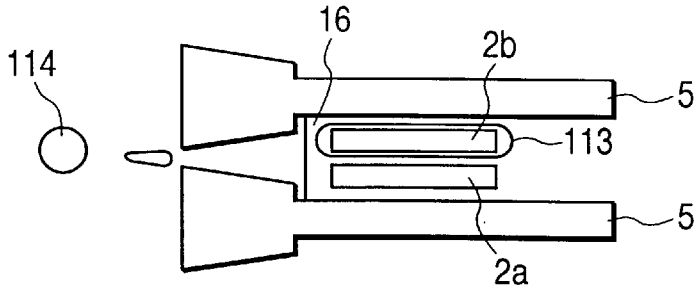
Figure 10D:
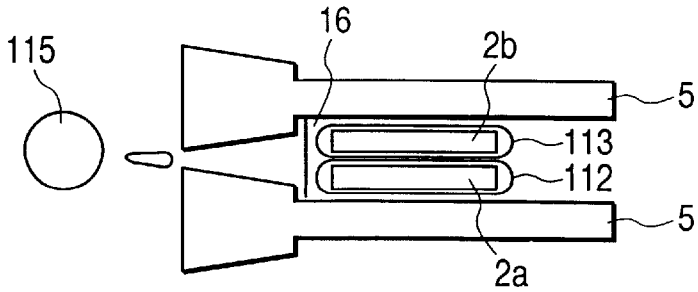

FIGS. 10A to 10D are cross-sectional views which schematically illustrate a fourth embodiment in accordance with the present invention. FIG. 10A is a cross-sectional view which shows the liquid jet head of the present embodiment, taken in the direction of the liquid flow path. FIGS. 10B to 10D are cross-sectional views taken along a line a—a in FIG. 10A.

The special feature of the present embodiment is that two heat generating elements 2*a* and 2*b* are arranged for one movable member in order to execute a gradation recording. The heat generating elements 2*a* and 2*b* for the present embodiment are formed in one and the same configuration and size. FIG. 10B shows a state where heat generating elements 2*a* and 2*b* are not driven, that is, it shows the liquid flow path when driving is at rest. Also, FIG. 10C shows the state where only the heat generating element 2*b* is driven, while the other one of them, that is, the heat generating element 2*a*, is not driven, so as to discharge a droplet 114 in a smaller volume. FIG. 10D shows the state where both heat generating elements 2*a* and 2*b* are driven simultaneously to discharge a droplet 115 in a larger volume.

In accordance with the present embodiment, the movable member 31 has already been displaced to the first liquid flow path 14 side when driving is at rest. Here, even when the droplet 114 having a smaller volume is discharged, there is no possibility that the pressure exerted by the creation of the air bubble for the initial operation of the movable member 31 is not exhausted much so often, and the smaller droplet 114 is discharged efficiently in good condition. Therefore, with the structure thus arranged, it is possible to record images with excellent gradation by the excellent discharging performance of smaller droplets.

Other Embodiments

Now, the description has been made of the embodiments of the principal parts of the liquid jet head and the liquid discharging method in accordance with the present invention. Hereinafter, in conjunction with the accompanying drawings, the description will be made of the examples of embodying modes preferably applicable to those embodiments described above. In the description given below, however, there are some cases where either one of the embodiments of the one liquid flow mode and two-liquid flow mode described above will be taken up, but unless otherwise specifically mentioned, such description will be applicable to both embodying modes.

Ceiling Configuration of the Liquid Flow Path

Figure 11:
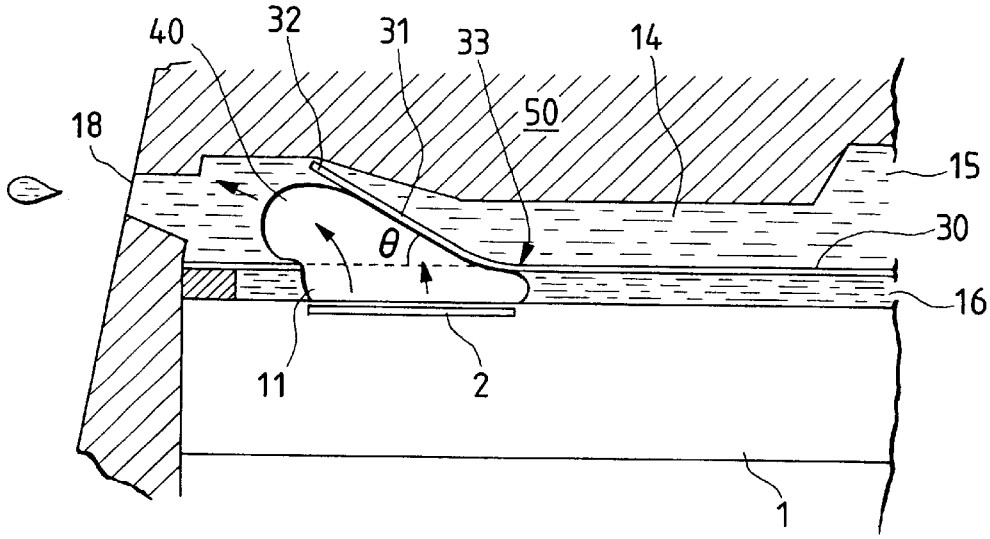
FIG. 11 is a cross-sectional view which illustrate the structure of the movable member and the first liquid flow path.

FIG. 11 is a cross-sectional view of the liquid jet head of the present invention, taken in the direction of its liquid flow path. Here, a grooved member 50, which is arranged to constitute the first liquid flow path 14 (or the liquid flow path 10 in FIG. 1A), is provided on the separation wall 30. The height of the liquid flow path ceiling is made larger in the vicinity of the position of the free end 32 of the movable member 31 so that the operational angle θ is made larger for the movable member 31. The operational range of the movable member 31 is determined by taking the structure of liquid flow paths, durability of the movable member, foaming power, and others into consideration, but conceivably, it should be desirable that the operation is possible up to the angle including the angle in the axial direction of each discharge port.

Also, as shown in FIG. 11, the transfer of the m discharging power becomes better still if the displacement height of the free end of the movable member 31 is made larger than the diameter of the discharge port. Further, as shown in FIG. 11, the height of the liquid flow path ceiling in the position of the fulcrum 33 of the movable member 31 is made smaller than that of the ceiling of the liquid flow path in the position of the free end 32 of the movable member 31. As a result, when the movable member 31 is displaced, the pressure waves are prevented from escaping to the upstream side more effectively.

Figure 12A:
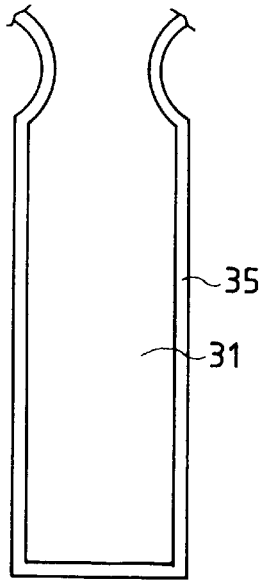
FIGS. 12A, 12B and 12C are plan views which illustrate the structure of the movable member and liquid flow path.
Figure 12B:
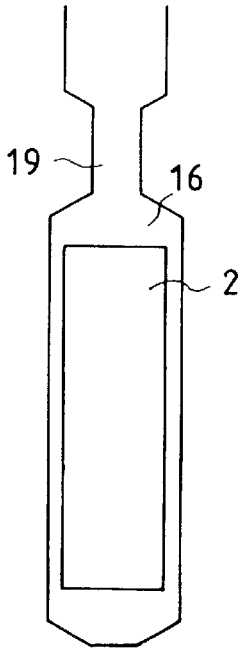
Figure 12C:
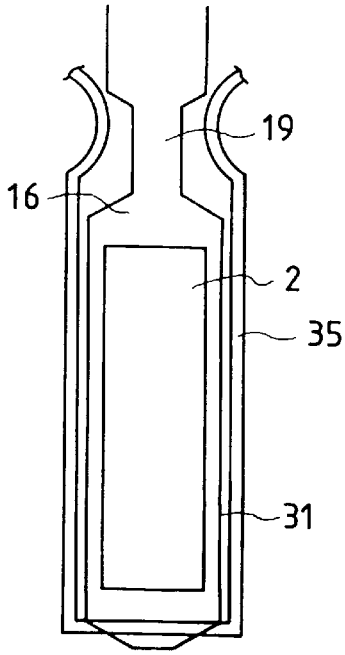

Relationship of Arrangement Between the Second Liquid Flow Path and the Movable Member FIGS. 12A to 12C are views illustrating the relationship of the arrangement between the movable member 31 and the second liquid flow path 16; FIG. 12A shows the separation wall 30 and the vicinity of the movable member 31, being observed from above; FIG. 12B shows the second liquid flow path 16 after removing the separation wall 30, being also observed from above; and FIG. 12C is a view schematically showing the relationship of the arrangement between the movable member 31 and the second liquid flow path 16 by overlapping each of these elements. Here, all the figures illustrate the front side where the discharge port 18 is arranged underneath each one of them.

The second liquid flow path 16 of the present embodiment is provided with a narrower portion 19 on the upstream side of the heat generating element 2 (here, the upstream side means the one in the large flow from the second common liquid chamber side to the discharge port 18 through the position of the heat generating element, movable member 31, and the first liquid flow path), and this path is structured like a chamber (foaming chamber) arranged to suppress foaming pressure so that it does not escape easily to the upstream side of the second liquid flow path 16.

If such narrower portion should be provided for the conventional head whose foaming and discharging paths are one and the same in anticipation that pressure exerted by each of the heat generating elements on each liquid chamber side does not escape to the common liquid chamber side, it is necessary to arrange the structure so as not to make the sectional area too small for the liquid flow path in the narrower portion, taking liquid refilling operation fully into consideration.

However, for the present embodiment, most of liquid in the first liquid flow path is used for discharging, while the arrangement can be made to suppress the consumption of foaming liquid in the second liquid flow path where each of the heat generating elements is provided. It may be possible, therefore, that the refilling amount of foaming liquid to the air bubble generating area 11 of the second liquid flow path is made smaller. As a result, the gap in the narrower portion described above is made as extremely small as several μm to ten and several μm in order to further suppress the escape of foaming pressure exerted in the second liquid flow path to its circumference. The pressure is led toward the movable member side intensively. Then, as this pressure can be utilized as discharge power through the movable member 31, it is possible to obtain higher discharging efficiency, and discharging power as well. In this respect, however, the configuration of the second liquid flow path 16 is not necessarily limited to the one adopted for the structure described above. It should be good enough if only such configuration is made so that the foaming pressure is effectively led to the movable member 31.

In this respect, as shown in FIG. 12C, the side of the movable member 31 covers a part of the wall that constitutes the second liquid flow path 16 in order to prevent the movable member 31 from falling off into the second liquid flow path, making the separation between the discharging liquid and the foaming liquid more reliable. Also, the escape of air bubble from the slit is suppressed in order to enhance both the discharging power and discharging efficiency more. In this way, the refilling effect from the upstream side is further improved by the utilization of pressure exerted at the time of defoaming.

Here, in FIG. 8B and FIG. 11, the air bubble created on the air bubble generating area of the second liquid flow path 16 is partly expanded into the first liquid flow path 14 side following the displacement of the movable member 31 to the first liquid flow path 14 side. However, by arranging the height of the second liquid flow path to allow the air bubble to expand in this manner, it is possible to enhance the discharging power still more as compared with the case where no expansion is possible. In order to effectuate such expansion of the air bubble into the first liquid flow path 14, it is preferable to make the height of the second liquid flow path 16 lower than the maximum height of the air bubble. This height should preferably be made from several μm to 30 μm. Here, the height is set at 15 μm for the present embodiment.

Movable Member and Separation Wall

Figure 13A:
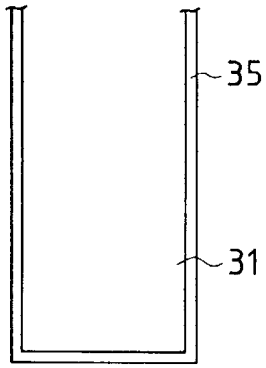
FIGS. 13A, 13B and 13C are plan views which illustrate the other configurations of the movable member.
Figure 13B:
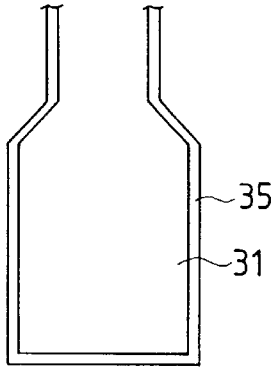
Figure 13C:
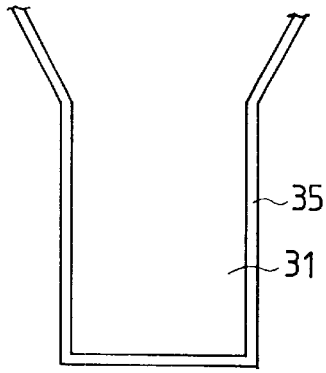
Figure 15:
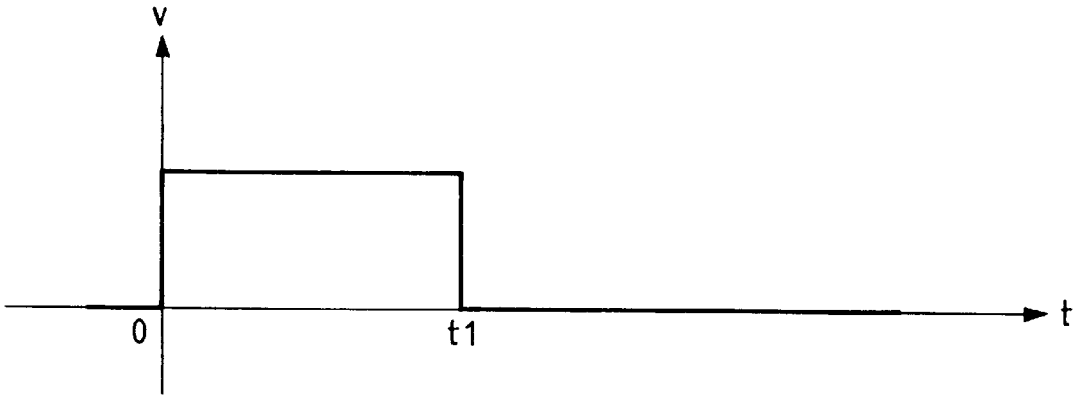
FIG. 15 is a view which schematically shows the shape of driving pulse.

FIGS. 13A to 13C are views that shows other configurations of the movable member 31. A reference numeral 35 designates each slit arranged for each of them. By means of the slit 35, the movable member 31 is formed. FIG. 13A shows an oblongly elongated configuration; FIG. 13B shows the configuration having narrower portion on the fulcrum side to facilitate the movement of the member; FIG. 13C shows the configuration having the widening portion on the fulcrum side to enhance the durability of the member. As the configuration that presents an easier movement and good durability as well, it is preferable to configure the member so that the width of its fulcrum side is made narrower in circular shape as shown in FIG. 13A. However, it should be good enough if only the movable member is configured not to occupy the second liquid flow path side, while facilitating its movement, but to present excellent durability.

For the previous embodiment, the flat type movable member 31 and the separation wall 30 having this movable member on it is formed by nickel of 5 μm thick. However, the material is not necessarily limited to it. As the material for the formation of a movable member and a separation wall, it should be good enough if only such material has solvent resistance to foaming liquid and discharging liquid, while having elasticity that allows good operation as a movable member, and also, properties that enable a fine slit to be formed therefor.

For the material of the movable member, it is preferable to use highly durable metal, such as silver, nickel, gold, iron, titanium, aluminum, platinum, tantalum, stainless steel, or phosphor bronze, or alloys thereof, or resin having acrylonitrile, butadiene, styrene or other nitrile group, resin having polyamide or other amide group, resin having polycarbonate or other carboxyl group, resin having polyacetal or other aldehyde group, resin having polysulfone or other sulfone group, or resin having liquid crystal polymer or the like and its chemical compound, such metal as having high resistance to ink as gold, tungsten, tantalum, nickel, stainless steel, or tantalum, or its alloys and those having them coated on its surface for obtaining resistance to ink, or resin having polyamide or other amide group, resin having polyacetal or other aldehyde group, resin having polyether ketone or other ketone group, resin having polyimide or other imide group, resin having phenol resin or hydroxyl group, resin having polyethylene or other ethyl group, resin having polypropylene or other alkyl group, resin having epoxy resin or other epoxy group, resin having melamine resin or other amino group, resin having xylene resin or other methylol group, and its compounds, and further, ceramics such as silicon dioxide and its compound.

For the material of the separation wall, it is preferable to use resin having good properties of resistance to heat and solvent, as well as good formability as typically represented by engineering plastics in recent years, such as polyethylene, polypropylene, polyamide, polyethylene terephthalate, melamine resin, phenol resin, epoxy resin, polybutadiene, polyurethane, polyether etherketone, polyether sulfone, polyarylate, polyimide, polysulfone, or liquid crystal polymer (LCP) and its compound or silicon dioxide, silicon nitride, nickel, gold, stainless steel or other metals, its alloys or those coated with titanium or gold.

Also, the thickness of the separation wall should be determined by the material and configuration from the viewpoint of whether or not desired strength and operatively are obtainable as a movable member using them. However, it is preferable to obtain a thickness of approximately 0.5 μm to 10 μm.

In this respect, the width of the slit 35 that forms the movable member 31 is set at 2 μm for the present embodiment. However, if it is desired to prevent any mixture of liquids when foaming liquid and discharging liquid are different ones, the width of the slit 35 is made a gap of a dimension that allows the formation of meniscus between both liquids, and the distribution of liquids themselves should be suppressed. For example, if liquid of approximately 2 cp (centipoise) is used as foaming liquid and liquid of approximately 100 cp or more is used as discharging liquid, it is possible to prevent its mixture even by the slit of approximately 5 μm wide, but it is preferable to make it 3 μm or less.

Elemental Substrate

Now, hereunder, the description will be made of the structure of an elemental substrate having heat generating elements arranged therefor to give heat to liquid.

Figure 14A:
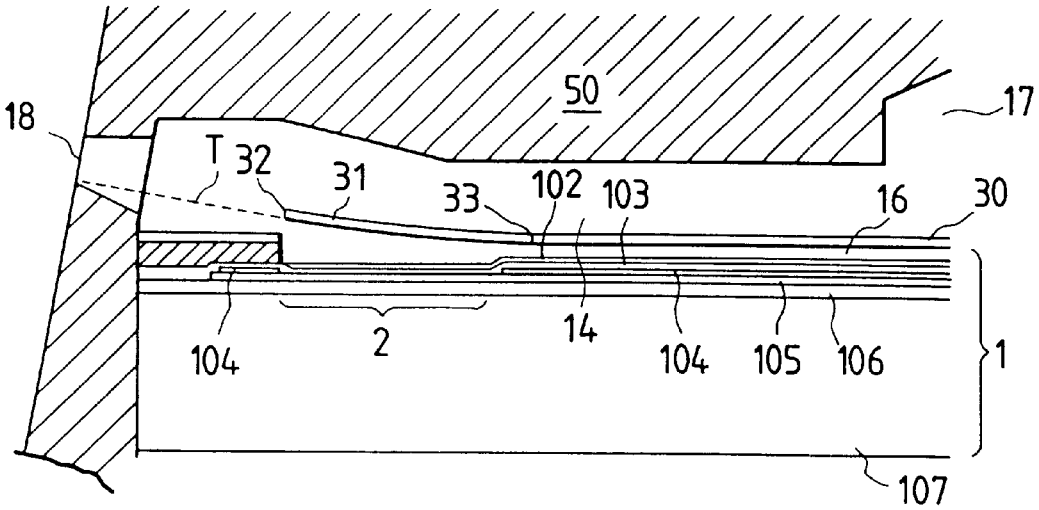
FIGS. 14A and 14B are vertically sectional views which illustrate the liquid jet head of the present invention.
Figure 14B:
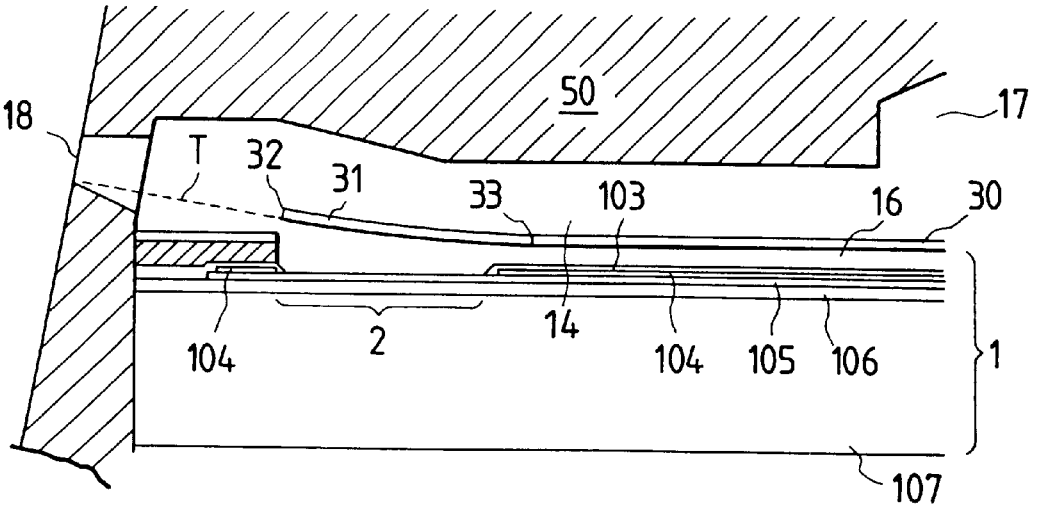

FIGS. 14A and 14B are vertically sectional views of liquid jet heads of the present invention; FIG. 14A shows a head having a protection film to be described later; and FIG. 14B shows a head having no protection film.

On the elemental substrate 1, a grooved member 50 is arranged, which is provided with the second liquid flow path 16, the separation wall 30, the first liquid flow path 14, and the groove forming the first liquid flow path.

For the elemental substrate 1, silicon oxide or silicon nitride film 106 is formed on a substrate 107 of silicon or the like for the purpose of insulation and heat accumulation, and on it, hafnium boride ($HfB_2$), tantalum nitride (TaN), tantalum aluminum (TaAl) or other electric resistance layer 105 (0.01 to 0.2 μm thick) aluminum wire electrodes (0.2 to 1.0 μm thick) or the like, are laminated and patterned as shown in FIGS. 10A to 10D. Voltage is applied to the resistance layer 105 from two wire electrodes 104 to cause current to ran on the resistance layer, thus generating heat. On the resistance layer across wire electrodes, a protection layer of silicon oxide or silicon nitride is formed in a thickness of 0.12 to 2.0 μm. Further, on it, an anti-cavitation layer of tantalum or the like is filmed (in a thickness of 0.1 to 0.6 μm). In this way, the resistance layer 105 is protected from ink or various other liquids.

Particularly, since the pressure and shock waves generated at the time of creating the air bubble, and of defoaming are extremely strong, the durability of the rigid and brittle oxide film is reduced significantly. Therefore, the tantalum (Ta) or other metal is used as an anti-cavitation layer.

Also, it may be possible to arrange a structure that does not require the protection layer described above by arranging the combination of liquid, the structure of liquid flow path, and resistive material. FIG. 14B shows the example thereof. As the material for the resistance layer that does not require such protection layer, an alloy of iridium-tantalum-aluminum or the like may be cited.

Then, for the structure of heat generating elements adopted for each of the embodiments described above, it may be possible to provide only resistance layer (heat generating layer) between the electrodes or to include the protection layer to protect the resistance layer.

For the present embodiment, heat generating elements are used, each having heat generating unit structured by the resistance layer that generates heat in response to electric signals. However, the present invention is not limited to the use of such heat generating elements. It should be good enough if only each of the heat generating elements is capable of creating air bubbles in liquid sufficiently so as to enable liquid to be discharged. For example, the optothermal transducing elements whose heat generating unit generates heat when receiving laser beam or other light or some other heat generating elements provided with heat generating unit that generates heat when receiving high frequency.

Here, for the elemental substrate 1 described above, it may be possible to incorporate transistors, diodes, latches, shift registers and other functional elements integrally in the semiconductor manufacturing process, besides the resistance layer 105 constituting the heat generating unit and the electrothermal transducing elements structured by the wire electrodes that supply electric signals to the resistance layer, in order to selectively drive the electrothermal transducing elements.

Also, in order to drive each heat generating unit of the electrothermal transducing elements arranged for the elemental substrate described above for discharging liquid, rectangular pulses are applied to the resistance layer 105 through the wire electrodes 104, thus causing the resistance layer between the wire electrodes to generate heat abruptly. For each head of the previous embodiments, electric signals are applied at 6 kHz to drive each of the heat generating element at the voltage of 24 V, with pulse width of 7 $\mu$sec, and current of 150 mA. With such operation, ink liquid is discharged from each of the discharge ports. However, the condition of the driving signals is not necessarily limited to the one described above. It should be good enough if only driving signals are such as to enable foaming liquid to foam appropriately.

Structure of Head Having Two-Flow Path Structure

Now, the description will be made of the structural example of a liquid jet head as given below, for which different liquids can be supplied to the first and second common liquid chambers separately in good condition, and it is possible to attempt reducing part numbers for the implementation of cost reduction.

Figure 16A:
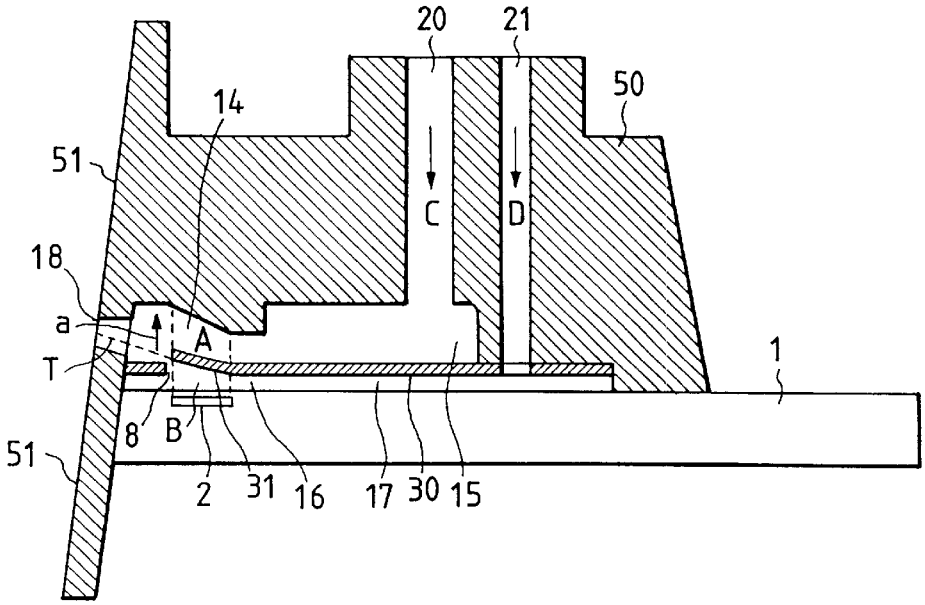
FIGS. 16A, 16B and 16C are cross-sectional views which illustrate the supply paths of the liquid jet head of the present invention.
Figure 16B:
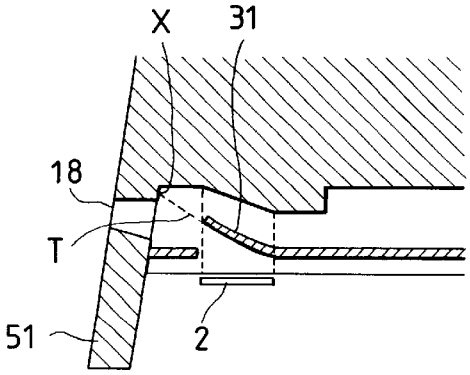
Figure 16C:
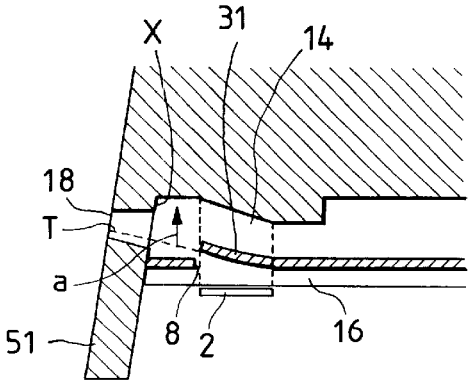

FIGS. 16A to 16C are views which schematically illustrate the structure of a liquid jet head of the kind. Here, the same reference marks are used for the same constituents as in the previous embodiment, and the detailed description thereof will be omitted.

For the present embodiment, the grooved member 50 comprises an orifice plate 51 having discharging ports 18; a plurality of grooves constituting a plurality of first liquid flow paths 14; and a recessed portion to form a first common liquid chamber 15 to supply liquid (discharging liquid) to each of the first liquid flow paths 14, thus presenting the outline of the structure thereof.

A separation wall 30 is adhesively bonded to the lower side portion of the grooved member 50 to form a plurality of first liquid flow paths 14. The grooved member 50 is provided with the first liquid supply path 20 that reaches the interior of the first common liquid chamber 15 from the upper part of the grooved member. Also, the grooved member 50 is provided with the second liquid supply path 21 that reaches the interior of the second common liquid chamber from the upper part of the grooved member through the separation wall 30.

The first liquid (discharging liquid) is supplied to the first common liquid chamber 15 through the first liquid supply path 20 as indicated by an arrow C in FIG. 16A, and then, supplied to the first liquid flow path 14. The second liquid (foaming liquid) is supplied to the second common liquid chamber 17 through the second liquid supply path 21 as indicated by an arrow D in FIG. 16A, and then, supplied to the second liquid flow path 16.

For the present embodiment, the second liquid supply path 21 is arranged in parallel with the first liquid supply path 20, but the arrangement is not necessarily limited to this structure. The arrangement can be made in any way if only the second liquid supply path is conductively connected with the second common liquid chamber 17 through the separation wall 30 arranged on the outer side of the first common liquid chamber 15.

Also, the thickness (diameter) of the second liquid supply path 21 may be determined in consideration of the supply amount of the second liquid. There is no need for the second liquid supply path 21 to be configured in circle. It may be configured in rectangle or the like.

Also, the second common liquid chamber 17 may be formed by partitioning the grooved member 50 by means of the separation wall 30. For the method of formation assembling, the frame of the common liquid chamber and the wall of the second liquid flow path are formed by dry film on the elemental substrate, and then, the second common liquid chamber 17 and the second liquid flow path 16 may be formed by adhesively bonding the elemental substrate 1, and the bonded element of the grooved member 50, and the separation wall 30 fixed to the grooved member together.

For the present embodiment, the elemental substrate 1, having a plurality of electrothermal transducing elements arranged therefor as heat generating elements to generate heat for the creation of air bubbles exerted by film boiling in foaming liquid, is arranged on a supporting element 70 formed by aluminum or the other metal.

On the elemental substrate 1, there are arranged a plurality of grooves to constitute the liquid flow path 16 formed by the wall of the second liquid flow path, a recessed portion to constitute the second common liquid chamber (common foaming liquid chamber) 17 conductively connected with a plurality of foaming liquid flow paths to supply foaming liquid to each of the foaming liquid paths, and the separation wall 30 having the movable member 31 described earlier.

A reference numeral 50 designates the grooved member. This grooved member is provided with a groove to constitute the discharge liquid flow path (first liquid flow path) 14 when adhesively bonded to the separation wall 30; a recessed portion to constitute the first common liquid chamber (common discharging liquid chamber) 15 to supply discharging liquid to each of the discharging liquid flow paths; the first supply path (discharging liquid supply path) 20 to supply discharging liquid to the first common liquid chamber; and the second supply path (foaming liquid supply path) 21 to supply foaming liquid to the second common liquid chamber 17. The second common liquid chamber 21 is connected to the communication path conductively connected with the second common liquid chamber 17 through the separation wall 30 arranged on the outer side of the first common liquid chamber 15. By means of this communication path, foaming liquid is supplied to the second common liquid chamber 15 without any mixture with discharging liquid.

In this respect, the positional relationship between the elemental substrate 1, separation wall 30, and grooved ceiling plate 50 is such that the movable member 31 can be arranged corresponding to the heat generating elements on the elemental substrate 1, and that the discharging liquid flow paths 14 are arranged corresponding to the movable member 31. Also, for the present embodiment, an example is shown in which one second supply path is arranged for the grooved member, but depending on the amount of supply, a plurality thereof may be arranged therefor. Further, the sectional areas for flow paths of the discharging liquid supply path 20 and foaming liquid supply path 21 may be determined in proportion to the respective supply amounts.

Here, by optimizing the sectional areas of such flow paths, it becomes possible to make the components that constitute the grooved member smaller.

In accordance with the present embodiment described above, it is possible to reduce the numbers of parts by arranging the grooved ceiling plate to function as one and the same member for the second liquid supply path to supply second liquid to the second flow path and the first liquid supply path to supply first liquid to the first liquid flow path, and then to curtail the number of processes, hence attaining the reduction of costs.

Also, since the structure is arranged so that the supply of second liquid to the second common liquid chamber conductively connected with the second liquid flow path is performed by means of the second liquid flow path in the direction penetrating the separation wall that separate the first liquid and the second liquid, it is possible to adhesively bond the separation wall, grooved member, and heat generating element formation substrate together by the adoption of only one-time process. Therefore, the fabrication is made easier, while enhancing the precision of adhesive bonding, hence leading to discharging liquid in good condition.

Also, since the second liquid is supplied to the second common liquid chamber via penetration of the separation wall, the second liquid is supplied to the second flow path reliably, thus making it possible to secure a sufficient amount of supply for the stabilized discharging.

As described earlier, it is desirable to enable the tangential line and the extended line of the movable member to reach the discharge port formation area on the liquid flow path side (that is, the discharge port portion in FIG. 16A, the upper surface in FIG. 16B, and the lower surface in FIG. 16C). However, with the discharging efficiency in view, it is particularly preferable to arrange them to intersect each other in the position on the discharge port portion as shown in FIG. 16A.

Discharging Liquid and Foaming Liquid

In accordance with the present invention described for the previous embodiment, it is possible to discharge liquid with higher discharging power and discharging efficiency than the conventional liquid jet head with the adoption of the structure provided with the movable member described earlier. The speed of liquid discharge is also made higher. When the same liquid is used as foaming liquid, and also, as discharging liquid for some of the structures embodying the present invention, it is possible to use various kinds of liquids if only the applying liquid is such that its quality is not deteriorated by the application of heat; it does not generate deposition easily on the heating elements when being heated; and it is capable of presenting reversible change of states by means of vaporization and condensation when being heated; and also, it does not cause each liquid flow path, movable member, and wall member to be deteriorated.

Of such liquids, it is possible to use ink having the composition used for the conventional bubble jet apparatus as liquid to be used for recording (recording liquid).

On the other hand, when different liquids are used as discharging liquid and foaming liquid, respectively, by use of a head having the two-flow path structure of the present invention, it should be good enough to use liquid having the properties described above as foaming liquid. More specifically, the following can be named: methanol, ethanol, n-propanol, isopropanol, n-hexan, n-heptane, n-octane, toluene, xylene, ethylene dichloride, trichrolo ethylene, Freon TF, Freon BF, ethyl ether, dioxane, cyclohexane, methyl acetate, ethyl acetate, acetone, methyl ether ketone, water, and its mixtures, among others.

As discharging liquid, various kinds of liquid can be used irrespective of the presence and absence of foaming property and thermal characteristics. Also, even the liquid whose foaming capability is low to make discharging difficult by use of the conventional head; the liquid whose properties are easily changeable or deteriorated when receiving heat; or the liquid whose viscosity is high; is usable as discharging liquid.

However, as the properties of discharging liquid, it is desirable that such liquid is the one that does not hinder discharging, foaming, and the operation of the movable member or the like by the discharging liquid itself or by reaction caused by its contact with foaming liquid.

As discharging liquid for recording, it is possible to use highly viscous ink or the like. As other discharging liquids, it may be possible to cite the use of such liquid as the medicine and perfume whose properties are not strong against heat.

For the present invention, recording is performed using ink having the following composition as a recording liquid capable of being used as both discharging liquid and foaming liquid; with the enhanced discharging power, the discharging speed of ink becomes high, making it possible to obtain recorded image of extremely high quality resulting from the enhanced impact accuracy of droplets:

Colorant ink having a viscosity of 2 cp:

| | |
|---|---|
| (C.I food black 2) Colorant | 3 wt % |
| diethylene glycol | 10 wt % |
| thiodiglycol | 5 wt % |
| ethanol | 5 wt % |
| water | 77 wt % |

Liquid Jet Head Cartridge

Now, the brief description will be made of the liquid jet head cartridge that mounts a liquid jet head prepared in accordance with the embodiments described above.

Figure 17:
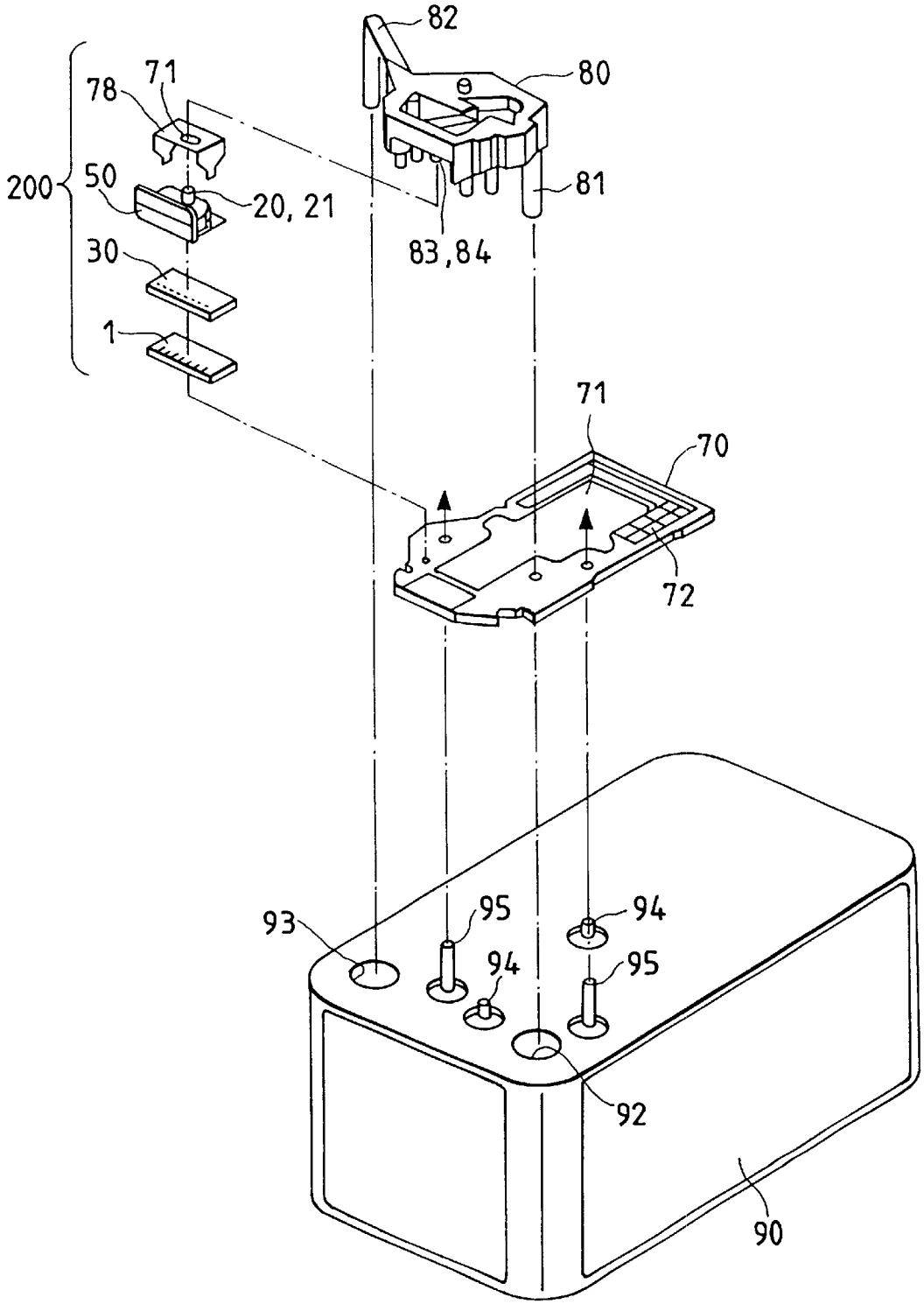
FIG. 17 is an exploded perspective view which shows a liquid jet head cartridge.

FIG. 17 is an exploded perspective view which schematically shows the liquid jet head cartridge including the liquid jet heat described earlier. This liquid jet head cartridge is structured mainly by the liquid jet head unit 200 and the liquid container 90 in accordance with its broad classification.

The liquid jet head unit 200 comprises the elemental substrate 1, the separation wall 30, the grooved member 50, the pressure spring 78, the liquid supply member 80, and the supporting element 70, among some others. A plurality of heat generating resistors (heat generating elements) are arranged in line on the elemental substrate 1. Also, a plurality of functional elements are arranged to selectively drive these heat generating resistors. Each of the air bubble generating area is formed between the elemental substrate 1 and the separation wall 30 having movable member arranged therefor. Foaming liquid is distributed thereto. The separation wall 30 and the grooved ceiling plate 50 are adhesively bonded to form the liquid flow path (not shown) is order to distribute the discharging liquid for discharging.

The pressure spring 78 is a member that actuates biasing force on the grooved member 50 in the direction of the elemental substrate 1. By the application of this biasing force, the elemental substrate 1, the separation wall 30, the grooved member 50, and the supporting element 70 are put together in good condition. The supporting element 70 is a member to support the elemental substrate 1 and others. On the supporting element 70, there are arranged the printed-circuit board 71, which is connected with the elemental substrate 1 to supply electric signals, and also, the contact pads 72, which are connected with the apparatus side to exchange electric signals with that side.

The liquid container 90 retains separately in it ink or other discharging liquid, and foaming liquid that creates each air bubble, which are supplied to the liquid jet head. Discharging liquid is supplied from the discharge liquid supply path 92 of the liquid container to the discharging liquid supply path 81 of the liquid supply member 80 through the supply path 84 of the connecting member, and then, supplied to the first common liquid chamber through each of the discharging liquid supply paths 83, 71, and 21 of each member, respectively. Likewise, foaming liquid is supplied from the supply path 93 of the liquid container to the foaming liquid supply path 82 of the liquid supply member 80 through the supply path of the connecting member, and then, supplied to the second liquid chamber through each of the foaming liquid supply paths 84, 71, and 22 of each member.

Now, the description has been made of the liquid jet head cartridge having the supply mode that enables foaming liquid and discharging liquid to be supplied as different liquids, and the liquid container as well. However, when the discharging liquid and foaming liquid are the same, the supply path for foaming liquid and that for discharging liquid are not necessarily separated.

In this respect, the liquid container may be used by refilling liquid after each liquid has been consumed. To this end, it is desirable to arrange a liquid injection port for the liquid container. Also, it may be possible to form the liquid jet head and liquid container integrally or to form them separately.

Liquid Jet Apparatus

Figure 18:
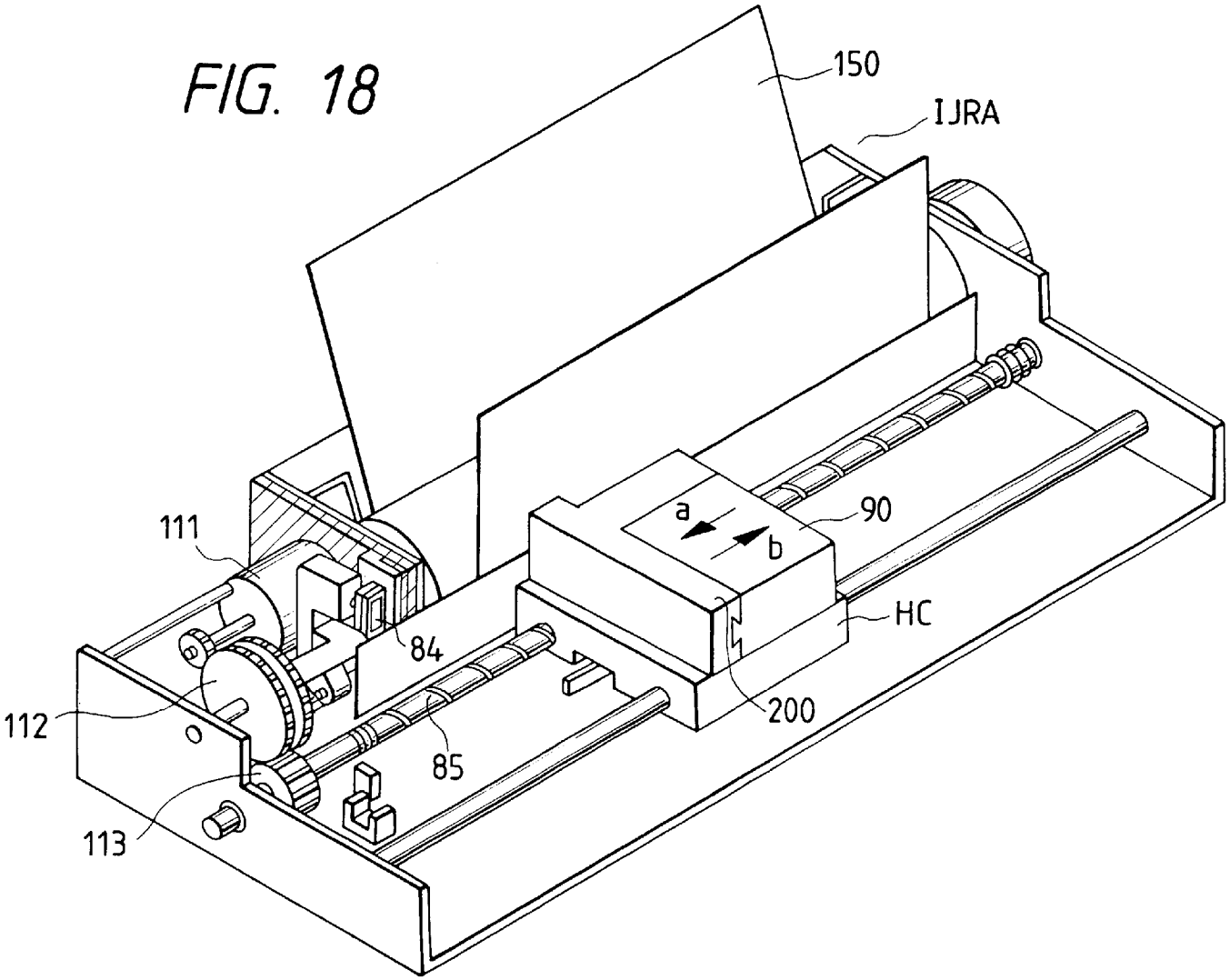
FIG. 18 is a structural view which shows the outline of a liquid jet apparatus.

FIG. 18 is a view which schematically shows the liquid jet apparatus that mounts the liquid jet head. Here, particularly, the description will be made of an ink jet recording apparatus using ink as discharging liquid. The carriage HC of the liquid jet apparatus mounts detachably the head cartridge, which comprises a liquid tank unit 90 for containing ink and liquid jet head unit 200, and reciprocates in the width direction of a receding medium, such as recording sheet, which is carried by recording medium carrier means.

When driving signals are supplied to the liquid jet head unit on the carriage HC from driving signal supply means (not shown), recording liquid is discharged from the liquid jet head onto the recording medium in response to these signals.

Also, the recording apparatus is provided with a motor 111 as the driving source, gears 112 and 113, and carriage shaft 85 or the like to transfer the driving power from the driving source to the carriage. It is possible to obtain recorded objects having good images by discharging liquid onto various kinds of recording media by use of this recording apparatus and liquid discharging method adopted for the recording apparatus.

Figure 19:
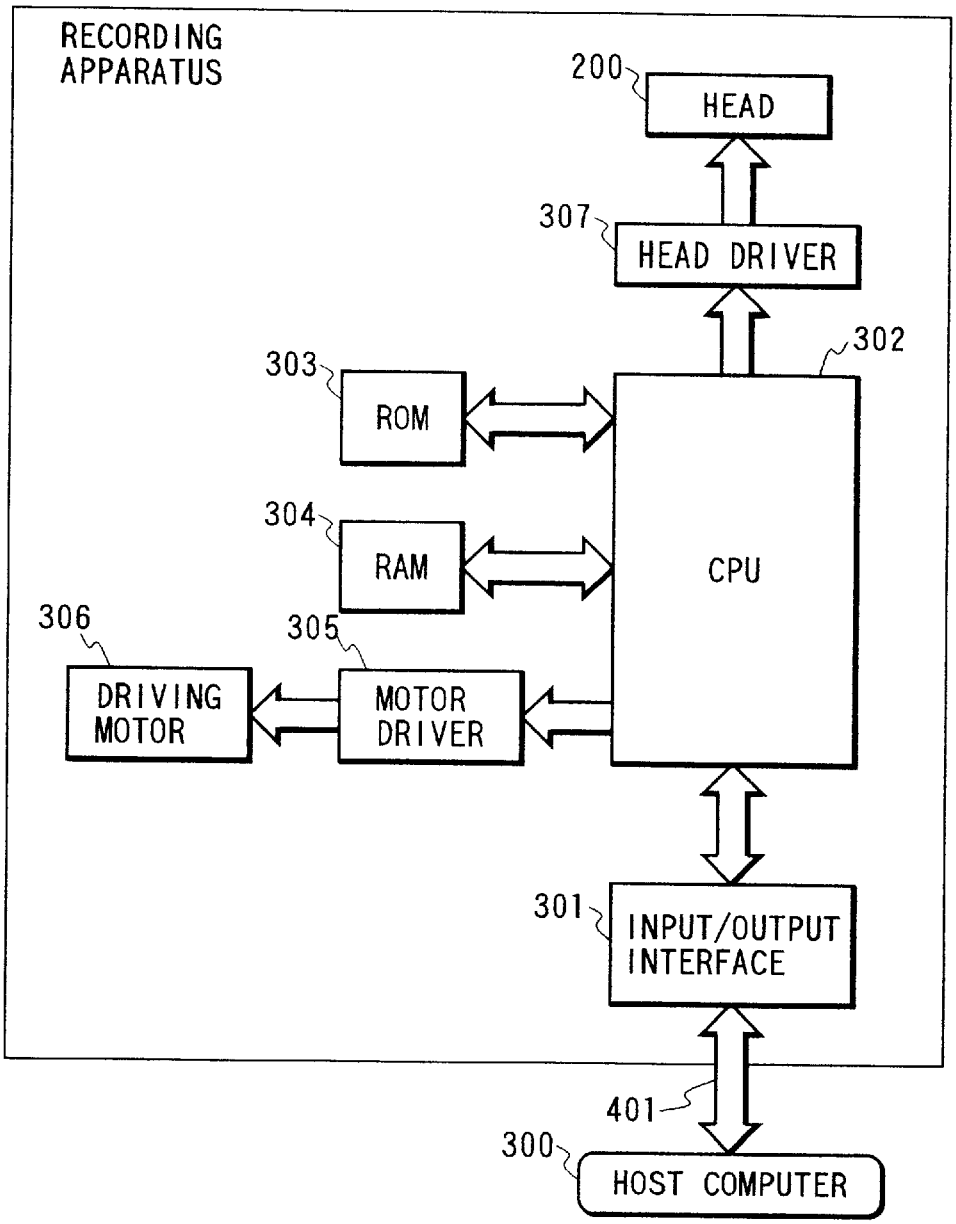
FIG. 19 is a block diagram which shows the structure of the apparatus.

FIG. 19 is a block diagram which shows the recording apparatus as a whole, which discharges ink for recording by the application of the liquid discharging method, and by use of the liquid jet head of the present invention.

This recording apparatus receives printing information from a host computer 300 as control signals. The printing information is provisionally stored in the input interface 301 of the recording apparatus. At the same time, the printing information is converted to the data that can be processed in the recording apparatus, thus being inputted into the CPU 302 that dually functions as means for supplying head driving signals. The CPU 302 processes the inputted data using peripheral units such as RAM 304 and others in accordance with the controlling program stored in the ROM 302, and converts them to printing data (image data).

Also, the CPU 302 produces motor driving data in order to drive the driving motor that carries the recording sheet and the recording head in synchronism with each other for recording the image data in appropriate positions on the recording sheet. The image data and driving data are transferred to the head 200 and driving motor 306 through the head driver 307 and the motor driver 305, respectively, which are driven in accordance with the controlled timing to form images.

As the recording medium usable by the recording apparatus described above for the provision of ink or other, there can be named various paper and OHP sheets, plastic materials used for compact disc, ornamental board, or the like, cloths, metallic materials such as aluminum and copper, cattle hide, pig hide, artificial leathers or other leather materials, wood, plywood, bamboo, tiles and other ceramic materials, sponge or other three-dimensional structures.

Also, as the recording apparatus described above, there can be named a printing apparatus for recording on various paper and OHP sheets, a recording apparatus for plastic use to record on compact disc and other plastic materials, a recording apparatus for recording on metallic plates, a recording apparatus for use to record on leathers, a recording apparatus for use to record on woods, a recording apparatus for use to record on ceramics, a recording apparatus for use to record on a three-dimensional net structure such as sponge. Also, a textile printing apparatus that records on cloths is included.

As discharging liquid used for these liquid jet apparatuses, it may be possible to use any one of the liquids depending on the kinds of recording media and recording condition.

Recording System

Now, description will be made of one example of ink jet recording system that uses the liquid jet head of the present invention as its recording head to perform recording on a recording medium.

Figure 20:
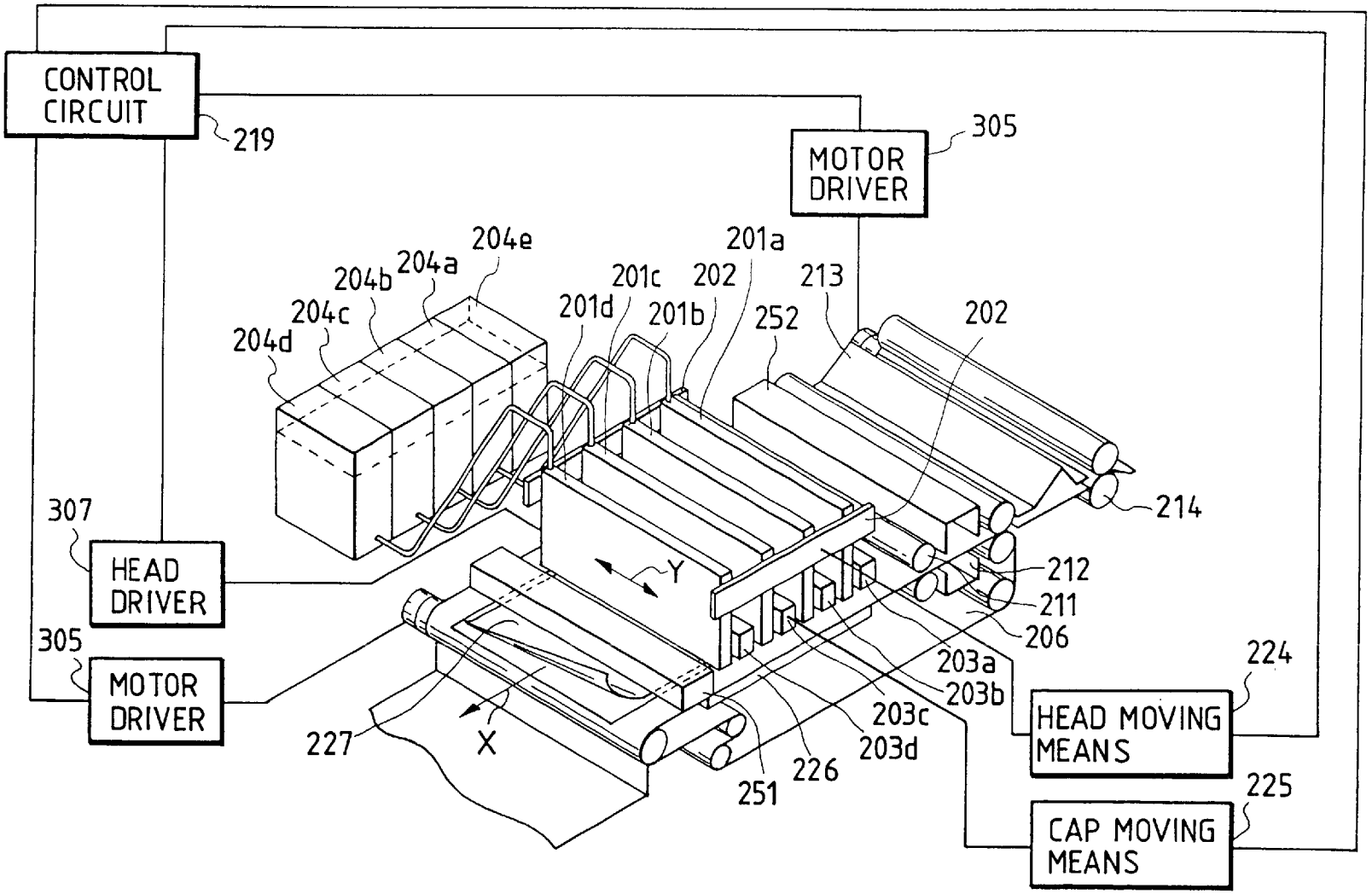
FIG. 20 is a view which shows a liquid jet recording system.

FIG. 20 is a view which schematically illustrate the structure of this ink jet recording system. The liquid jet head of the present embodiment is a full line type head where a plurality of discharge ports are arranged in the length that corresponds to the recordable width of a recording medium 150 at the interval (density) of 360 dpi. Four liquid jet heads 201*a*, 201*b*, 201*c*, and 201*d* are fixedly supported by the holder 202 in parallel to each other at given intervals in the direction X corresponding to four colors, yellow (Y), magenta (M), cyan (C), and black (Bk), respectively. From the head driver 307 constituting driving signal supplying means, signals are supplied to each of the liquid jet heads.

To each of the heads, four different color ink, Y, M, C, Bk, are supplied from the ink containers 204*a* to 204*d* as discharging liquid, respectively. Also, the structure is arranged so that foaming liquid is stored in the foaming liquid container 204*e* and supplied to each of the liquid jet heads.

Also, below each of the liquid jet heads, head caps 203*a* to 203*d* are arranged with sponge or other ink absorbing material contained in them to cover the discharge ports of the liquid jet heads in order to maintain each of the heads when recording operation is at rest.

Here, a reference numeral 206 designates a carrier belt 206 is arranged to constitute carrier means for carrying each kind of recording medium as described earlier for each of the embodiments. This carrier belt 206 is drawn around various rollers at given passage and driven by driving rollers connected with the motor driver 305.

Also, for the ink jet recording system of the present embodiment, a pre-processing device 215, and post-processing device 252 are installed on the upstream and downstream of the recording medium carrier passage to perform various processes with respect to the recording medium before and after recording.

The pre-processing and post-processing are different in the contents of the corresponding process depending on the kinds of recording media and kinds of ink. For example, with respect to recording on a medium such as metal, plastic, or ceramic, ultraviolet lays and ozone are irradiated to activate the surface of the medium used, thus improving the adhesion of ink thereto. Also, when recording on a medium, such as plastic, that easily generates static electricity, dust particles are easily attracted to the surface thereof to hinder good recording in some cases. Therefore, as the pre-processing device, an ionizer is used to remove static electricity. In this way, dust particles should be removed from the recording medium. Also, when cloths are used as a recording medium, a pre-processing may be performed to provide a substance selected from among alkali substance, water-soluble substance, synthetic polymer, water-soluble metallic salt, urea, and thiourea for recording on cloths in order to prevent stains on them, while improving its coloring rate. However, the pre-processing is not necessarily limited to those described above. It may be the process to adjust the temperature of a recording medium appropriately to a temperature suited for recording on such medium.

On the other hand, fixation process is performed as the post-processing to promote the fixation of ink by executing heating process or irradiation of ultraviolet rays, among some others, for the recording medium for which ink has been provided. Cleaning process is also performed as a post-processing to rinse off the processing agent provided for the recording medium in the pre-processing but still remaining inactive.

Here, the description has been made in assumption that a full line head is used as the liquid jet head, but the present invention is not necessarily limited to it. It may be possible to apply the present invention to such a mode that the smaller liquid jet head described earlier is carried in the width direction of a recording medium for recording.

Head Kit

Figure 21:
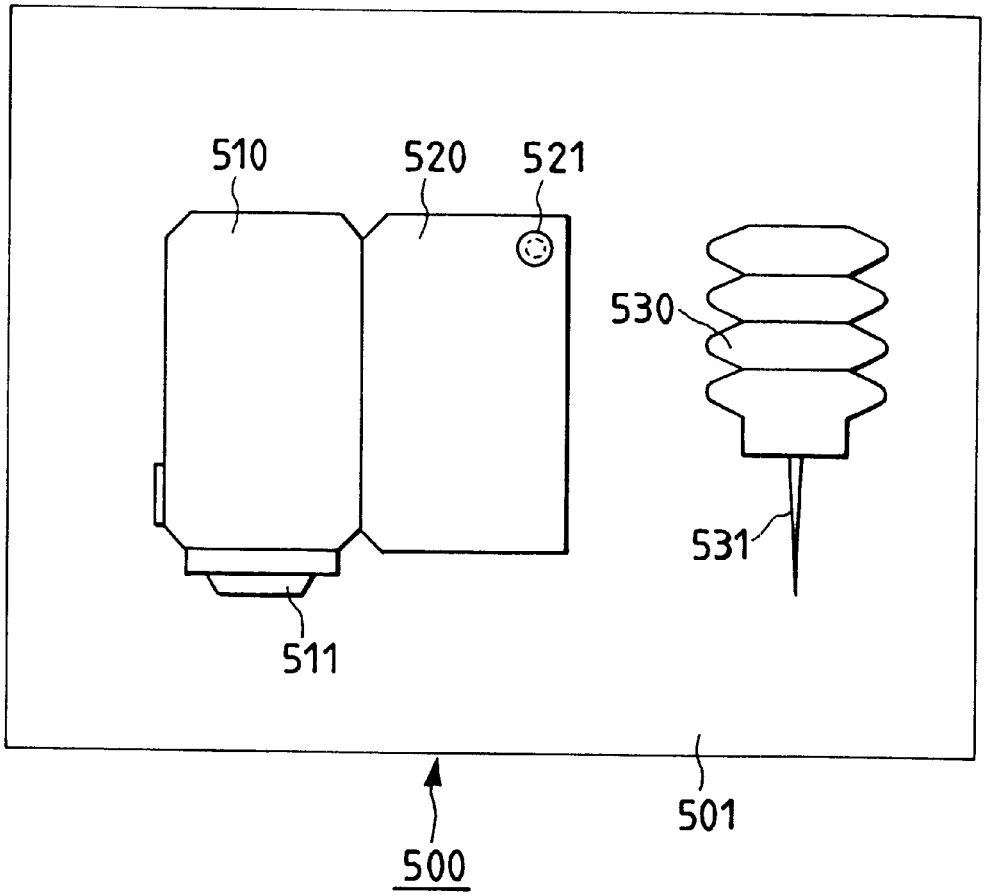
FIG. 21 is a view which schematically shows a head kit.
Figure 22A:
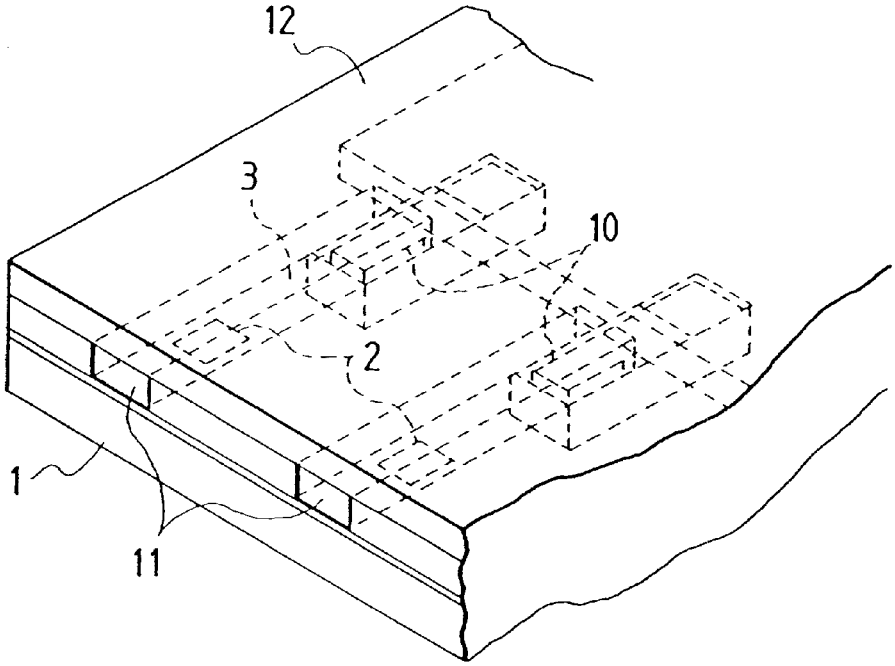
FIG. 22A Prior Art
FIGS. 22A and 22B are views which illustrate the liquid flow structure of the conventional liquid jet head.
Figure 22B:
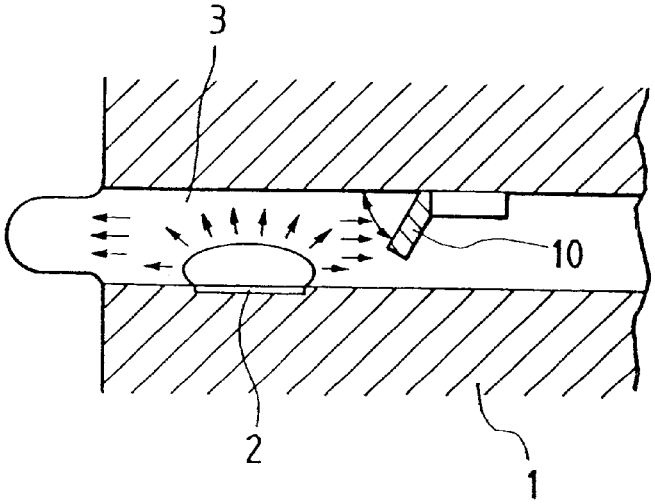
FIG. 22B Prior Art

Hereinafter, the description will be made of the head kit provided with the liquid jet head of the present invention. FIG. 21 is a view schematically showing such head kit.

This head kit houses, in the kit container 501, a liquid jet head 510 provided with an ink discharge unit 511 for discharging ink; an ink container 520, which is separable or inseparable from the liquid jet head 510; and ink filling means retaining ink to be filled into the ink container 520.

When ink has been consumed, the injection unit (injection needle and others) 531 of the ink filling means is partly inserted into the air communication port 521 of the ink container 520, the connector with the head, or the hole open on the wall of ink container 520, and then, through such inserted portion, ink in the ink filling means is filled in the ink container.

In this way, the liquid jet head of the present invention, ink container, and ink filling means are housed in one kit container. Then, when ink has been consumed, ink is easily filled in the ink container immediately as described above, hence making it possible to begin recording promptly.

In this respect, the description has been made here in assumption that the ink filling means is included in the head kit, but as a head kit, it may be possible to adopt a mode in which only a separable type ink container having ink filled in it, and the liquid jet head are housed in the kit container 510 without any ink filling means. Also, FIG. 21 shows only ink filling means usable for filling ink to the ink container, but it may be possible to adopt a mode in which foaming liquid filling means for filling foaming liquid to a foaming liquid container is housed in the kit container, besides the ink container.

As described above, in accordance with the liquid discharging method, head, and others of the present invention based upon the new discharging principle using the movable members, it is possible to obtain the mutually potentiating effect of the creation of air bubbles and the movable members capable of being displaced thereby for discharging liquid residing in the vicinity of discharge ports efficiently. As compared with the conventional bubble jet type discharging method, head, and others, the discharging efficiency is significantly enhanced when adopting those of the present invention.

Also, in accordance with the present invention, the free end of each movable member is displaced to the side away from the air bubble generating area when driving is at rest. Therefore, it is possible to reduce the push-up load exerted on each movable member when it receives foaming pressure from the air bubble generating area for leading foaming pressure to the discharge port, and also, for pushing up liquid residing above the movable member when driving is in operation. Consequently, foaming pressure is led to the discharge port effectively, thus making the enhancement of discharging efficiency possible.

Also, with the structures characteristic to the present invention, it is possible to prevent discharging from being disabled even when the head is left intact for a long time at low temperatures and low humidity. If a disabled discharging should take place in such a case, it is easily recovered by slightly executing a recovery process, such as pre-discharging or suction recovery. There is an advantage then that the discharging condition is immediately restored to the normal one. Therefore, it is possible to make the time required for recovery shorter and to reduce liquid loss resulting from the recovery that takes a longer time. Hence, the significant reduction of running costs are also attainable.

Also, with the structure arranged in accordance with the present invention, which contributes to enhancing the refilling performance significantly, it is possible to attain a better response at the time of performing a continuous discharge;

the stabilized development of air bubbles; and the droplet stabilization for recording at high speeds by such high-speed liquid discharging, and recording images of high quality as well.

Also, using the liquid jet head of the present invention it is possible to provide a liquid jet apparatus and a recording system the liquid discharging efficiency of which is further enhanced, among other improved functions.

Also, using the head cartridge and head kit of the present invention it is made easy to utilize and reuse the head.

What is claimed is:

1. A liquid jet head provided with discharge ports formed in discharge port formation areas for discharging liquid, liquid flow paths conductively connected with said discharge ports, bubble generating areas for creating bubbles in said liquid, and movable members arranged to face said bubble generating areas, each said movable member having a free end in a position relatively near to a respective one of said discharge ports with respect to a fulcrum thereof, each said movable member being arranged at a position where the free end of each said movable member is located such that each said bubble generating area is in fluid communication with the said respective discharge port such that a line tangent to the free end of each said movable member reaches directly a respective one of said discharge port formation area at a liquid flow path side when each said movable member is not displaced before the creation of a bubble on each said bubble generating area, and with this position as a reference, each said movable member moves after the creation of the bubble on each said bubble generating area.

2. A liquid jet head provided with first liquid flow paths conductively connected with discharge ports formed in discharge port formation areas for discharging liquid, second liquid flow paths having bubble generating areas to give heat to liquid so as to create a bubble in said liquid, and movable members arranged to face said bubble generating areas, each said movable member having a free end in a position relatively near to a respective one of said discharge ports with respect to a fulcrum thereof, the free end having a tangential line, the free end of each said movable member being disposed so that each said second liquid flow path and each said first liquid flow path are in fluid communication by arranging each said movable member so that said tangential line reaches directly a respective one of said discharge port formation areas at a liquid flow path side before the creation of the bubble when each said movable member is not displaced following the pressure exerted by the creation of the bubble on each said bubble generating area.

3. A liquid jet head according to claim 2, wherein heat generating element is arranged on an elemental substrate to create the bubble on said bubble generating area, and said movable members is inclined with respect to said elemental substrate before the creation of said bubble.

4. A liquid jet head according to claim 3, wherein said heat generating element is an electrothermal transducing element having heat generating resistive body generating heat when receiving electric signal.

5. A liquid jet head according to claim 3, wherein the distance from the surface of said heat generating element to the fulcrum of said movable member is 3 $\mu$m or less.

6. A liquid jet head according to claim 2, wherein a length of projection of each said movable member to an elemental substrate covers the length of a heat generating element.

7. A liquid jet head according to claim 2, wherein a projection of each said movable member to an elemental substrate covers a heat generating element.

8. A liquid jet head according to claim 2, wherein a plurality of heat generating elements are arranged on an elemental substrate with respect to each said movable member.

9. A liquid jet head according to claim 2, wherein an intersecting point between an extended line of the tangential line of the free end of each said movable member, and an inner surface of a respective one of said discharge ports on said liquid flow path side is positioned below an uppermost end position of the inner surface of a discharge port portion having said respective discharge port at the time of operation being at rest.

10. A liquid jet head according to claim 1 or claim 2, wherein the free end of each said movable member is positioned downstream of a center of an area of a heat generating element.

11. A liquid jet head according to claim 1 or claim 2, wherein said head is provided with a supply path to supply liquid to a heat generating element from upstream of said heat generating element.

12. A liquid jet head according to claim 11, wherein said supply path is provided with a substantially flat or smooth inner wall on the upstream side of said heat generating element, and said supply path supplies liquid to said heat generating element along said inner wall.

13. A liquid jet head according to claim 1 or claim 2, wherein said bubble is a bubble created by film boiling generated in liquid by heat generated by said heat generating element.

14. A liquid jet head according to claim 1 or claim 2, wherein said movable member is in the form of a flat plate.

15. A liquid jet head according to claim 1 or claim 2, wherein the configuration of said movable member changes depending on temperatures.

16. A liquid jet head according to claim 15, wherein said change of configuration is a change becoming larger in the distance between said free end and said bubble generating area as temperature becomes lower.

17. A liquid jet head according to claim 15, wherein said movable member is formed by bimetal.

18. A liquid jet head according to claim 1 or claim 2, wherein an upper limit stopper is provided for regulating the upper limit of the displacement of said movable member.

19. A liquid jet head according to claim 1 or claim 2, wherein a lower limit stopper is provided for regulating the lower limit of the displacement of said movable member.

20. A liquid jet head according to claim 2, wherein each said movable member is formed as a part of a separation wall arranged between each said first flow path and each said second flow path.

21. A liquid jet head according to claim 20, wherein said separation wall is formed by metallic material.

22. A liquid jet head according to claim 2, wherein a first common liquid chamber is arranged to supply liquid to a plurality of said first liquid flow paths, and a second common liquid chamber is arranged to supply liquid to a plurality of said second liquid flow paths.

23. A liquid jet head according to claim 2, wherein liquid supplied to said first liquid flow path and liquid supplied to said second liquid flow path are the same liquid.

24. A liquid jet head according to claim 2, wherein liquid supplied to said first liquid flow path and liquid supplied to said second liquid flow path are different liquids.

25. A liquid jet head according to claim 1 or claim 2, wherein liquid discharged from said discharge port is ink.

26. A head cartridge, comprising the following:

a liquid jet head according to claim 2; and a liquid container retaining a first liquid to be supplied to the first liquid flow path, and a second liquid to be supplied to the second liquid flow path.

27. A liquid discharging method, comprising the steps of:

preparing a liquid jet head provided with discharge ports formed in discharge port formation areas for discharging liquid, liquid flow paths conductively connected with said discharge ports, bubble generating areas for creating bubbles in said liquid, and movable members arranged to face said bubble generating areas, each said movable member having a free end in a position relatively near to a respective one of said discharge ports with respect to a fulcrum thereof;

causing each said movable member to be arranged at a position where the free end of each said movable member releases each said bubble generating area partly to said respective discharge port so as to enable a tangential line of the free end of each said movable member or an extended line thereof to reach directly a respective one of said discharge port formation areas at a liquid flow path side before the creation of a bubble on each said bubble generating area; and with this position as a reference, moving each said movable member following the creation of a bubble on each said bubble generating area.

28. A liquid discharging method discharging liquid by the creation of bubbles, comprising the steps of:

preparing a liquid jet head provided with first liquid flow paths conductively connected with discharge ports formed in discharge port formation areas for discharging liquid, second liquid flow paths having bubble generating areas to give heat to liquid so as to create the bubbles in said liquid, and movable members arranged to face said bubble generating areas, each said movable member having a free end in a position relatively near to a respective one of said discharge ports with respect to a fulcrum thereof, at the same time, the free end of each said movable member being disposed so that each said second liquid flow path and each said first liquid flow path are in fluid communication by arranging each said movable member so that said tangential line reaches directly a respective one of said discharge port formation areas at a liquid flow path side before the creation of the bubbles which displace each said movable member following the pressure exerted by the creation of the bubbles on each said bubble generating area; and moving the free end of each said movable member by pressure exerted by the creation of the bubbles on each said bubble generating area to discharge liquid from said respective discharge port.

29. A liquid discharging method according to claim 27, or claim 28, wherein a heat generating element is arranged on an elemental substrate to create the bubble on each said bubble generating area, and said movable members are inclined with respect to said elemental substrate before the creation of said bubble.

30. A liquid discharging method according to claim 29, wherein said free end is positioned on the downstream side of liquid flow from the center of the area of said heat generating element.

31. A liquid discharging method according to claim 29, wherein liquid is supplied to said heat generating element along an inner wall substantially flat or smooth on the upstream side of said heat generating element.

32. A liquid discharging method according to claim 29, wherein the fulcrum of said movable member is not positioned immediately above said heat generating element.

33. A liquid discharging method according to claim 27 or claim 28, wherein said movable member is provided with the free end on the downstream with respect to the fulcrum, and said free end is displaced centering on said fulcrum.

34. A liquid discharging method according to claim 28, wherein a part of the bubble created extends and resides in said first liquid flow path along the displacement of said movable member.

35. A liquid discharging method according to claim 27 or claim 28, wherein heat generated by heat generating element is transferred to liquid to generate film boiling phenomenon in said liquid, and said bubble is a bubble created by said film boiling phenomenon.

36. A liquid discharging method according to claim 28, wherein liquid supplied to said first liquid flow path and liquid supplied to said second liquid flow path are the same liquid.

37. A liquid discharging method according to claim 28, wherein liquid supplied to said first liquid flow path and liquid supplied to said second liquid flow path are different liquids.

38. A head cartridge, comprising:

a liquid jet head provided with discharge ports formed in discharge port formation areas for discharging liquid, liquid flow paths conductively connected with said discharge ports, bubble generating areas for creating bubbles in said liquid, and movable members arranged to face said bubble generating areas, each said movable member having a free end in a position relatively near to a respective one of said discharge ports with respect to a fulcrum thereof, each said movable member being arranged at a position where the free end of each said movable member is located such that each said bubble generating area is in fluid communication with said respective discharge port such that a line tangent to the free end of each said movable member reaches directly a respective one of said discharge port formation areas at a liquid flow path side before the creation of a bubble on each said bubble generating area, and with this position as a reference, each said movable member moves after the creation of the bubble on each said bubble generating area; and a liquid container containing a liquid for supply to said liquid jet head.

39. A head cartridge, comprising:

a liquid jet head provided with first liquid flow paths conductively connected with discharge ports formed in discharge port formation areas for discharging liquid, second liquid flow paths having bubble generating areas to give heat to liquid so as to create a bubble in said liquid, and movable members arranged to face said bubble generating areas, each said movable member having a free end in a position relatively near to a respective one of said discharge ports with respect to a fulcrum thereof, the free end having a tangential line, the free end of each said movable member being positioned so that each said second liquid flow path and each said first liquid flow path are in fluid communication by arranging each said movable member so that said tangential line reaches directly a respective one of said discharge port formation areas at a liquid flow path side before the creation of the bubble which displaces each said movable member through the pressure exerted by the creation of the bubble on each said bubble generating area; and a liquid container containing a liquid for supply to said liquid jet head.

40. A head cartridge according to claim 38 or claim 39, wherein said liquid jet head and said liquid container are separable.

41. A head cartridge according to claim 38 or claim 39, wherein said liquid container is refilled with liquid.

42. A liquid jet apparatus, comprising:

a liquid jet head provided with discharge ports formed in discharge port formation areas for discharging liquid, liquid flow paths conductively connected to face bubble generating areas, each said movable member having a free end in a position relatively near to a respective one of said discharge ports with respect to a fulcrum thereof, each said movable member being arranged at a position where the free end of each said movable member is located such that each said bubble generating area is in fluid communication with said respective discharge port such that a line tangent to the free end of each said movable member reaches directly a respective one of said discharge port formation areas at a liquid flow path side before the creation of the bubble on each said bubble generating area, and with this position as a reference, each said movable member moves after the creation of the bubble on each said bubble generating area; and means for carrying a recording medium past said liquid jet head to receive liquid discharged from said liquid jet head.

43. A liquid jet apparatus, comprising:

a liquid jet head provided with first liquid flow paths conductively connected with discharge ports formed in discharge port formation areas for discharging liquid, second liquid flow paths having bubble generating areas to give heat to liquid so as to create a bubble in said liquid, and movable members arranged to face said bubble generating areas, each said movable member having a free end in a position relatively near to a respective one of said discharge ports with respect to a fulcrum thereof, the free end having a tangential line, the free end of each said movable member being disposed such that each said second liquid flow path and each said first liquid flow path are in fluid communication by arranging each said movable member so that said tangential line reaches directly a respective one of said discharge port formation areas at a liquid flow path side before the creation of the bubble when each said movable member is not displaced following the pressure exerted by the creation of the bubble on each said bubble generating area; and means for carrying a recording medium to carry a recording medium past said liquid jet head to receive liquid discharged from said liquid jet head.

44. A liquid jet apparatus according to claim 42 or claim 43, further comprising:

means for supplying driving signals to provide said liquid head with driving signals for discharging liquid therefrom.

45. A liquid jet apparatus according to claim 42 or claim 43, wherein ink is discharged from said liquid jet head to cause ink to adhere to a recording sheet for recording.

46. A liquid jet apparatus according to claim 42 or claim 43, wherein recording liquids in plural colors are discharged from said liquid jet head for recording in colors by causing said recording liquids in plural colors to adhere to said recording medium.

47. A liquid jet apparatus according to claim 42 or claim 43, wherein a plurality of said discharge ports are arranged over the entire width of the recordable area of a recording medium.

48. A head kit, including:

a liquid jet head provided with discharge ports formed in discharge port formation areas for discharging liquid, liquid flow paths conductively connected to face bubble generating areas, each said movable member having a free end in a position relatively near to a respective one of said discharge ports with respect to a fulcrum thereof, each said movable member being arranged at a position where the free end of each said movable member is located such that each said bubble generating area is in fluid communication with said respective discharge port such that a line tangent to the free end of each said movable member reaches directly a respective one of said discharge port formation areas at a liquid flow path side before the creation of the bubble on each said bubble generating area, and with this position as a reference, each said movable member moves after the creation of the bubble on each said bubble generating area; and a liquid container containing a liquid for supply to said liquid jet head.

49. A head kit, including:

a liquid jet head provided with first liquid flow paths conductively connected with discharge ports formed in discharge port formation areas for discharging liquid, second liquid flow paths having bubble generating areas to give heat to liquid so as to create a bubble in said liquid, and movable members arranged to face said bubble generating areas, each said movable member having a free end in a position relatively near to a respective one of said discharge ports with respect to a fulcrum thereof, the free end having a tangential line, the free end of each said movable member being disposed such that each said second liquid flow path and each said first liquid flow path are in fluid communication by arranging each said movable member so that said tangential line reaches directly a respective one of said discharge port formation areas at a liquid flow path side before the creation of the bubble when each said movable member is not displaced following the pressure exerted by the creation of the bubble on each said bubble generating area; and a liquid container containing a liquid for supply to said liquid jet head.

50. A head kit according to claim 48 or claim 49, wherein said liquid is ink for recording.

51. A head kit, comprising:

a liquid jet head provided with discharge ports formed in discharge port formation areas for discharging liquid, liquid flow paths conductively connected with said discharge ports, bubble generating areas for creating bubbles in said liquid, and movable members arranged to face said bubble generating areas, each said movable member having a free end in a position relatively near to a respective one of said discharge ports with respect to a fulcrum thereof, each said movable member being arranged at a position where the free end of each said movable member is located such that each said bubble generating area is in fluid communication with said respective discharge port such that a line tangent to the free end of each said movable member reaches directly a respective one of said discharge port formation areas at a liquid flow path side before the creation of the bubbles on each said bubble generating area, and with this position as reference, each said movable member moves after the creation of the bubbles on each said bubble generating area;

a liquid container containing a liquid for supply to said liquid jet head; and means for filling liquid into said liquid container.

52. A head kit, comprising:

a liquid jet head provided with first liquid flow paths conductively connected with discharge ports formed in discharge port formation areas for discharging liquid, second liquid flow paths having bubble generating areas to give heat to liquid so as to create a bubble in said liquid, and movable members arranged to face said bubble generating areas, each said movable member having a free end in a position relatively near to a respective one of said discharge ports with respect to a fulcrum thereof, the free end having a tangential line, the free end of each said movable member being disposed such that each said second liquid flow path and each said first liquid flow path are in fluid communication by arranging each said movable member so that said tangential line reaches directly a respective one of said discharge port formation areas at a liquid flow path side before the creation of the bubble when each said movable member is not displaced following the pressure exerted by the creation of the bubble on each said bubble generating area; and a liquid container containing a liquid for supply to said liquid jet head; and means for filling liquid into said liquid container.

53. A head kit according to claim 51 or claim 52, wherein said liquid is ink for recording.

* * * * *